US005313925A

United States Patent [19]

Otsuka et al.

[11] Patent Number: 5,313,925

[45] Date of Patent: May 24, 1994

[54] APPARATUS FOR DETECTING MALFUNCTION IN FUEL EVAPORATIVE PRURGE SYSTEM

[75] Inventors: Takayuki Otsuka, Susono; Nobuaki Kayanuma, Gotenba; Kouichi Osawa; Hironori Okamizu, both of Susono; Chikao Kunimasa, Okazaki, all of Japan

[73] Assignee: Toyota Jidosha Kabushiki Kaisha, Aichi, Japan

[21] Appl. No.: 62,351

[22] Filed: May 13, 1993

Related U.S. Application Data

[63] Continuation of Ser. No. 771,445, Oct. 4, 1991, Pat. No. 5,230,319.

[30] Foreign Application Priority Data

Oct. 5, 1990 [JP] Japan ..... 2-267889
Jan. 18, 1991 [JP] Japan ..... 3-4687

[51] Int. Cl.[5] ..... F02M 37/04
[52] U.S. Cl. ..... 123/520; 123/198 D
[58] Field of Search ..... 123/520, 519, 518, 521, 123/516, 198 D; 73/118.1

[56] References Cited

U.S. PATENT DOCUMENTS

| | | | |
|---|---|---|---|
| 4,318,383 | 3/1982 | Iratani | 123/520 |
| 4,358,905 | 7/1982 | Urich | 123/525 |
| 4,671,107 | 6/1987 | Chiisa | 703/118.1 |
| 4,846,155 | 7/1989 | Tiphaine | 123/520 |
| 4,867,126 | 9/1989 | Yonekawa | 123/520 |
| 4,901,702 | 2/1990 | Beicht | 123/520 |
| 4,949,695 | 8/1990 | Uranishi | 123/520 |
| 4,962,744 | 10/1990 | Uranishi | 123/519 |
| 5,021,071 | 6/1991 | Reddy | 55/58 |
| 5,067,469 | 11/1991 | Hamburg | 123/520 |

FOREIGN PATENT DOCUMENTS

| | | | |
|---|---|---|---|
| 58-185966 | 10/1983 | Japan . | |
| 2-130256 | 5/1990 | Japan . | |
| 2136558 | 5/1990 | Japan | 123/519 |

*Primary Examiner*—Carl S. Miller
*Attorney, Agent, or Firm*—Kenyon & Kenyon

[57] ABSTRACT

A malfunction detection apparatus for detecting a malfunction in an evaporated fuel purge system in which fuel vapor from a fuel tank is adsorbed in an adsorbent in a canister and the adsorbed fuel vapor in the adsorbent is purged into an intake passage of an engine. The apparatus includes a detection part for detecting a concentration of fuel in the fuel vapor purged into the intake passage so that a change in the detected fuel concentration from a time when a purge cutting is performed to a time when a purging is performed after the purge cutting has been performed is detected, and a discrimination part for determining whether there is a malfunction in the system on the basis of the change in the detected fuel concentration by the detection part. The apparatus also includes a fuel vapor detection part for detecting a condition of fuel vapor in the fuel tank, and a purge cut time varying part for varying a purge cut time period for which the purge cutting is continuously performed, the purge cut time being varied by the purge cut time varying part in response to the detected fuel vapor condition by the fuel vapor detection part.

5 Claims, 21 Drawing Sheets

11
INTERNAL COMBUSTION ENGINE
12
15
CONCENTRATION DETECTING PART
16
MALFUNCTION DISCRIMINATING PART
14
PURGE PART
13
FUEL TANK
17
PURGE CUT TIME VARYING PART
108
FUEL VAPOR DETECTING PART

APPARATUS FOR DETECTING MALFUNCTION IN FUEL EVAPORATIVE PRURGE SYSTEM

This application is a continuation of application Ser. No. 07/771,445, filed on Oct. 4, 1991, now U.S. Pat. No. 5,230,319.

BACKGROUND OF THE INVENTION (1) Field of the Invention

The present invention generally relates to a malfunction detection apparatus, and more particularly to an apparatus for detecting a malfunction in an evaporated fuel purge system provided in an internal combustion engine, in which fuel vapor evaporated in a fuel tank is adsorbed in an adsorbent in a canister and the adsorbed fuel vapor is purged into an intake passage in given operating conditions.

(2) Description of the Related Art

Conventionally, in an internal combustion engine, an evaporated fuel purge system is provided for storing fuel vapor, which is evaporated in a fuel tank, temporarily in an adsorbent in a canister, and for purging the stored fuel vapor in the adsorbent into an intake passage of the engine under given operating conditions. In order to prevent the evaporated fuel vapor in the fuel tank from escaping to the atmosphere, the component parts, the connecting pipes and the passages in the evaporated fuel purge system are all sealed. However, in a case in which a connecting pipe in the system is separated, or a purge supply passage is damaged due to a trouble in the evaporated fuel purge system, the fuel vapor from the fuel tank may escape to the atmosphere. In a case where the purge passage leading to the intake passage of the engine is clogged with foreign matter, too much fuel vapor is stored in the canister and the excessive fuel vapor may leak from an air inlet of the canister to the atmosphere. Therefore, it is necessary to detect a malfunction which may take place in the evaporated fuel purge system.

In the meantime, in an internal combustion engine equipped with an electronic control type fuel injection control unit, an air-fuel ratio (A/F) feedback control device is provided for maintaining the air-fuel mixture, supplied to the combustion chamber of the internal combustion engine, at a predetermined target air-fuel ratio. For example, Japanese Laid-Open Patent Application No.63-186954 discloses such an A/F feedback control device, and a description of A/F feedback correction factor included therein is hereby incorporated into the present specification. In this A/F feedback control device, a basic fuel injection time during which fuel is injected to the combustion chamber is calculated on the basis of an intake passage vacuum pressure (or a manifold absolute pressure) and an engine speed, and the calculated basic fuel injection time is adjusted suitably in response to an output signal of an oxygen sensor mounted in an exhaust passage of the engine. Conventionally, the A/F feedback control system uses an air-fuel ratio (A/F) feedback correction factor FAF for correcting the basic fuel injection time, the basic fuel injection time being multiplied by the factor FAF, which is determined in response to the output signal of the oxygen sensor, and several other factors in order to obtain a suitably adjusted fuel injection time. Japanese Laid-Open Patent Application No.2-136558 discloses a conventional malfunction detecting device for use in the internal combustion engine with the A/F feedback control system. In this malfunction detecting device, a purge control valve is switched on and off in response to the internal pressure of the fuel tank which is higher than a predetermined level, and the change in the A/F feedback correction factor FAF between the times when the purge control valve is switched on and off is detected. And, if the change in the FAF is not greater than a predetermined value, then it is determined by the malfunction detecting device that there is a malfunction in the evaporated fuel purge system. The reasons why the malfunction discrimination is made when the internal pressure is higher than a predetermined level is to prevent the malfunction detection from being erroneously performed due to excessively small amount of fuel vapor which is adsorbed in the canister.

However, in a case of the above described conventional malfunction detecting device, the amount of the adsorbed fuel vapor in the canister is relatively small immediately after the internal pressure of the fuel tank reaches the predetermined level. The change in the FAF in such cases is too small, and it is difficult to accurately detect a malfunction in the evaporated fuel purge system, and an erroneous malfunction detection may be made in some cases.

One conceivable method for storing the amount of fuel vapor in the canister, required for accurate malfunction detection, is to stop the purging of fuel vapor into the intake passage for a relatively long time period. However, during the purging stop time period, the temperature of fuel in the fuel tank becomes very high. Also, in a case in which a fuel of the kind including much evaporative components is supplied, unnecessarily abundant fuel vapor is adsorbed in the canister. For these reasons, the above mentioned purge stopping method also has a problem in that the adsorbing capacity of the canister is lowered from its normal level, and a part of the fuel vapor evaporated in the fuel tank would leak from the canister if such undesired phenomenon takes place repeatedly.

SUMMARY OF THE INVENTION

Accordingly, it is a general object of the present invention to provide an improved malfunction detection apparatus in which the above described problem of the conventional apparatus are eliminated.

Another and more specific object of the present invention is to provide a malfunction detection apparatus which comprises a purge part for performing alternately a purging mode and a purge cutting mode, fuel vapor from a fuel tank being adsorbed in an adsorbent in a canister when the purge cutting mode is performed by the purge part, and when the purging mode is performed by the purge part the adsorbed fuel vapor in the adsorbent being purged into an intake passage of the internal combustion engine, a detection part for detecting a concentration of fuel in the fuel vapor purged into the intake passage by the purge part so that a change in the detected fuel concentration from a time for the purge cutting mode being performed to a time for the purging mode being performed immediately after the purge cutting mode has been performed is detected, a malfunction discrimination part for determining whether there is a malfunction in the evaporated fuel purge system, by comparing the change in the detected fuel concentration by the detection part with a predetermined value, a fuel vapor detection part for detecting a condition of fuel vapor in the fuel tank, and a purge cut time varying part for determining a purge cut time, during which the purge cutting mode is continuously performed by the purge part, the purge cut time being varied by the purge cut time varying part in response to the fuel vapor condition in the fuel tank detected by the fuel vapor detection part. According to the present invention, a change in the detected fuel concentration from a time for the purge cutting mode being performed to a time for the purging mode being performed can be made great enough to accurately detect a malfunction in the evaporated fuel purge system, thus reducing erroneous malfunction detections to the least possible level. The purge cut time period is suitably adjusted in response to the condition of fuel vapor evaporated in the fuel tank and the fuel vapor can be stably and safely adsorbed in the adsorbent in the canister. Also, according to the present invention, the amount of the adsorbed fuel vapor in the adsorbent in the canister can be maintained at the minimum level necessary for performing accurately a malfunction detection, regardless of the fuel supply amount or the residual fuel amount. Thus, it is also possible to prevent the adsorbing capacity of the canister from being lowered from the normal level due to an excessively great amount of fuel vapor adsorbed in the canister.

Other objects and further features of the present invention will become more apparent from the following detailed description when read in conjunction with the accompanying drawings.

DESCRIPTION OF THE PREFERRED EMBODIMENT

Figure 1:
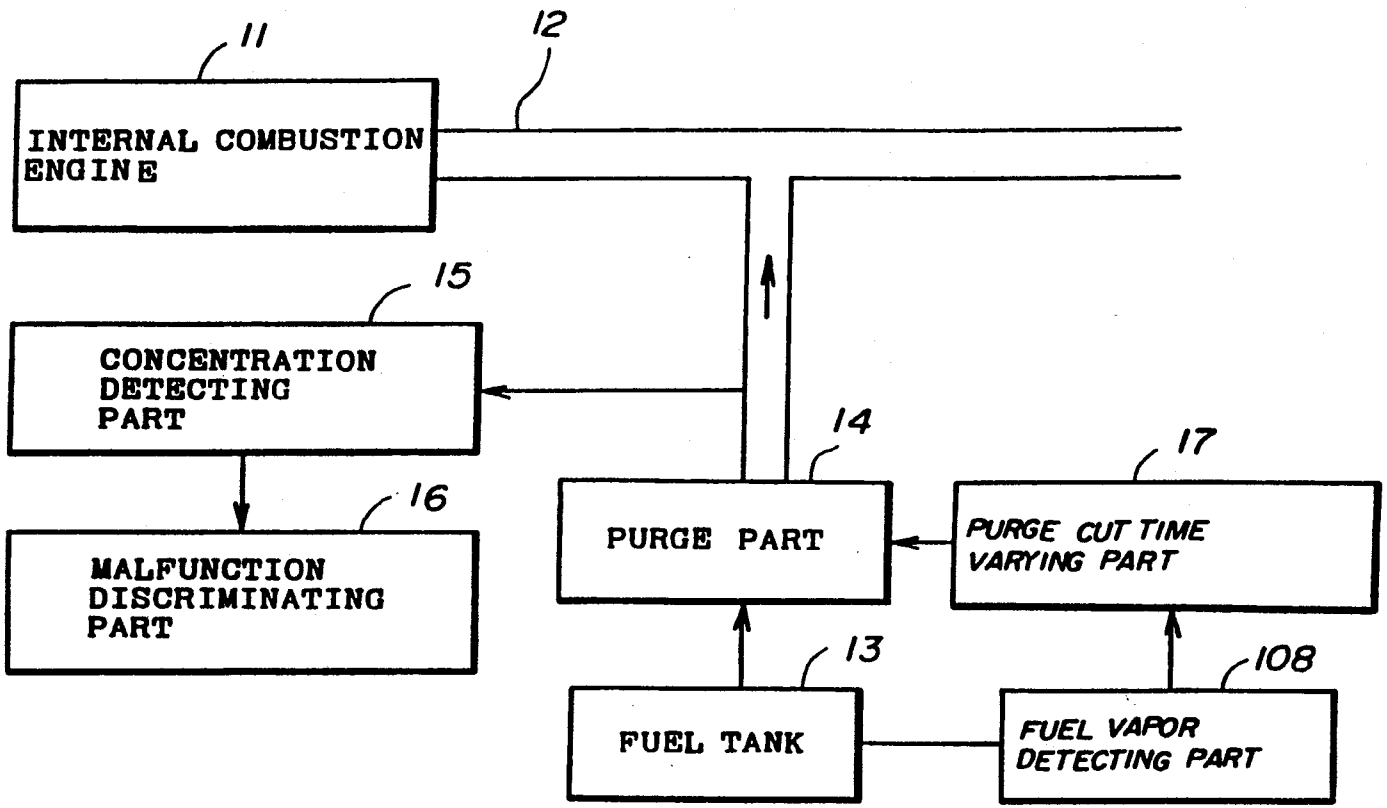
FIG. 1 is a block diagram for explaining an embodiment of a malfunction detection apparatus according to the present invention.

First, a description will be given of a first embodiment of a malfunction detection apparatus according to the present invention, with reference to FIG. 1. In FIG. 1, this malfunction detection apparatus includes a purge part 14 for performing alternately a purge cutting mode and a purging mode, fuel vapor from a fuel tank 13 is adsorbed in an adsorbent in a canister when the purge cutting mode is performed, and the adsorbed fuel vapor in the adsorbent in the canister is purged into an intake passage 12 of an internal combustion engine 11 when the purging mode is performed. The malfunction detection apparatus also includes a concentration detecting part 15 for detecting a concentration of fuel in the purged fuel vapor into the intake passage 12 by the purge part 14 so that a change in the detected fuel concentration from a time when the purge cutting mode is performed to a time when the purging mode is performed immediately after the purge cutting mode is ended is detected, and a malfunction discriminating part 16 for determining whether there is a malfunction by comparing the change in the detected fuel concentration by the concentration detecting part 15 with a predetermined value. The malfunction detection apparatus also includes a fuel vapor detection part 180 for detecting a condition of fuel vapor in the fuel tank 13, and a purge cut time varying part 17 for varying a purge cut time, during which the purge cutting mode is performed and the purging of fuel vapor into the intake passage by the purge part is stopped, in response to the condition of fuel vapor in the fuel tank detected by the fuel vapor detection part 180. Generally speaking, the rate of evaporation of fuel in the fuel tank 13 is changed depending on the temperature of fuel in the fuel tank 13, the amount of fuel supply newly supplied and the amount of residual fuel in the fuel tank 13. The purge cut time varying part 17 of the present invention adjusts suitably the purge cut time on the basis of several factors related to the rate of evaporation of fuel in the fuel tank 13 which is detected by the fuel vapor detection part 180. Therefore, the necessary amount of fuel vapor for the malfunction discrimination can be adsorbed in the adsorbent in the canister during the purge cut time before a malfunction discrimination is made by the malfunction discriminating part 16. Also, it is possible to control the purge cut time, during which the purging of fuel vapor is stopped, to the least possible level, so that an appropriate amount of fuel vapor is always stored in the adsorbent in the canister.

Figure 2:
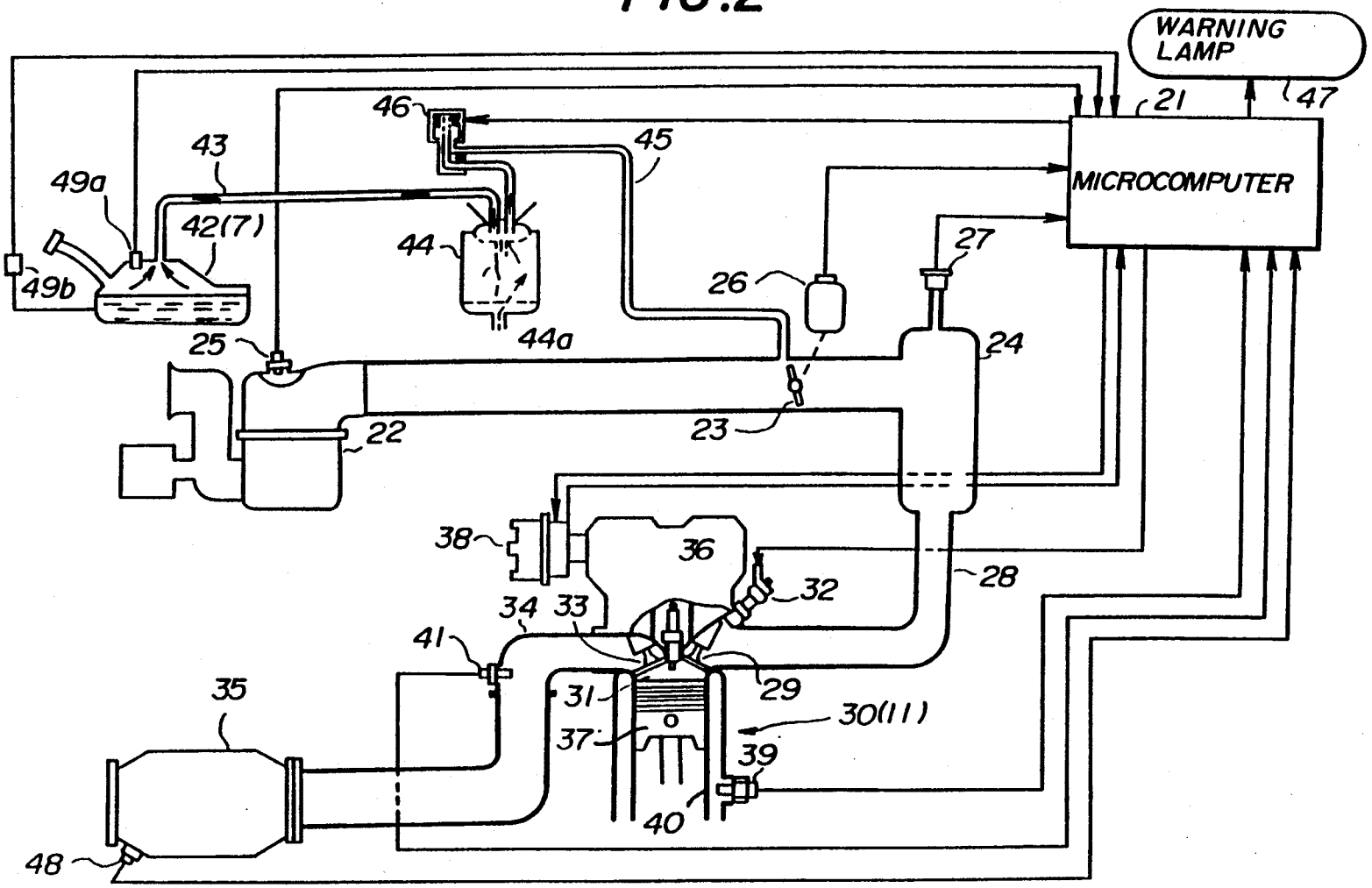
FIG. 2 is a schematic view showing a detailed structure of an evaporated fuel purge system which is provided in an internal combustion engine.

FIG. 2 shows an evaporated fuel purge system provided in an internal combustion engine to which an embodiment of the malfunction detection apparatus according to the present invention may be applied. The internal combustion engine 11 shown in FIG. 1 is, for example, a 4-cylinder, 4-cycle, spark-ignition-type internal combustion engine 30 as shown in FIG. 2, and the operations of the malfunction detection apparatus are controlled by a microcomputer 21 shown in FIG. 2. In FIG. 2, an air cleaner 22 is provided at an inlet portion of an intake passage of the engine 30, and an intake air temperature sensor 25 is mounted on the intake passage at a portion adjacent to the air cleaner 22 for supplying a signal, indicative of a temperature of intake air in the intake passage, to the microcomputer 21. A surge tank 24 is provided downstream of the air cleaner 22 in the intake passage, and a diaphragm type vacuum sensor 27 is mounted on the surge tank 24 for supplying to the microcomputer 21 a signal indicative of an absolute pressure of the air in the intake manifold. And, a throttle valve 23 is provided at an intermediate portion between the air cleaner 22 and the surge tank 24, and a throttle position sensor 26 is mounted on the throttle valve 23 for supplying a signal, indicative of a valve opening position of the throttle valve 23, to the microcomputer 21. The intake passage 12 described above is formed by an intake manifold 28, an intake valve 29 (which are included in the engine 30), the air cleaner 22 and the surge tank 24.

The surge tank 24 communicates with a combustion chamber 31 provided for each of cylinders of the engine 30 via the intake passage. A fuel injector 32 is provided at the combustion chamber 31 for each of the engine cylinders such that the fuel injector 32 partially projects into the intake manifold 28. The fuel injector 32 injects fuel to the intake air passing through the intake passage for a time period as instructed by the microcomputer 21.

The internal combustion engine 30 includes an exhaust valve 33 and an exhaust manifold 34 so that exhaust gas from the combustion chamber 31 is fed into an exhaust passage via the exhaust valve 33 and the exhaust manifold 34. An spark plug 36 is provided on the engine 30 such that the spark plug 36 partially projects into the combustion chamber 31, and a piston 37 is provided for each of the engine cylinders so that the piston 37 is subject to reciprocative movement in up/down directions of FIG. 2. A distributer 38 supplies a high voltage, which is generated by an igniter, to the spark plug 36 for each of the engine cylinders, and the distributer 38 supplies to the microcomputer 21 a signal indicative of a crank angle of the engine and a signal indicative of a crank angle reference position, which are both detected from the rotation of a distributer shaft.

A water temperature sensor 39 is provided on the engine 30 such that a part of the water temperature sensor 39 projects into a water jacket through an engine block 40, the water temperature sensor 39 supplying to the microcomputer 21 a signal indicative of a temperature of engine cooling water in the engine 30. An oxygen sensor 41 is provided on the exhaust manifold 34 such that the oxygen sensor 41 partially projects into the exhaust manifold 34, and the oxygen sensor 41 supplying to the microcomputer 21 a signal indicative of a concentration of oxygen in exhaust gas from the engine 30 before the exhaust gas enters a catalytic converter 35. And, an exhaust gas temperature sensor 48 is mounted on the catalytic converter 35 for supplying to the microcomputer 21 a signal indicative of a temperature of the catalyst in the catalytic converter 35. A fuel tank 42, which corresponds to the fuel tank 13 shown in FIG. 1, contains fuel therein, and fuel vapor evaporated in the fuel tank 42 is fed into a canister 44 through a vapor passage 43. The canister 44 is filled with an adsorbent such as activated carbon, and the canister 44 is provided with an air inlet **44*a* which communicates with the atmosphere. A purge passage 45 is provided so as to connect the canister 44 to a portion of the intake passage in the vicinity of the throttle valve 23. In another embodiment, the purge passage 45 may be formed so as to connect the canister 44 to the surge tank 24**.

A vacuum switching valve (VSV) 46 is provided at an intermediate portion of the purge passage 45 for adjusting suitably a valve opening position of the VSV opening position in accordance with a control signal supplied by the microcomputer 21, so that the flow rate of the fuel vapor purged from the canister 44 to the intake passage is controlled by the VSV 46. The purge part 14 shown in FIG. 1 is formed by the canister 44, the VSV 46, the vapor passage 43, the purge passage 45 and the microcomputer 21.

Fuel vapor evaporated in the fuel tank 42 is sent to the canister 44 through the vapor passage 43, and the fuel vapor is adsorbed in the adsorbent in the canister 44, preventing the fuel vapor from escaping to the atmosphere from the air inlet **44*a*. When a vacuum pressure is produced in the intake manifold 28 during operation of the engine 30, external air is sent from the air intake 44*a* to the canister 44 so that the fuel vapor is desorbed from the adsorbent and such fuel vapor is sent by the VSV 46 to the intake passage through the purge passage 45**. The adsorbent such as activated carbon is regenerated due to the above desorption and placed in a waiting condition for a next vapor adsorption.

A warning lamp 47 is connected to the microcomputer 21 for giving a warning of a malfunction to a driver when the malfunction is detected by the malfunction detection apparatus. In the first embodiment, a fuel gage **49*b* is provided on the fuel tank 42 for supplying to the microcomputer 21 a signal indicative of the amount of fuel included in the fuel tank 42. The fuel gage 49*b* is formed by a sender and a receiver, and operates electrically. In another embodiment, a pressure sensor 49*a* is provided, instead of the fuel gage 49*b*, on the fuel tank 42 for supplying to the microcomputer 21 a signal indicative of a pressure of fuel vapor evaporated in the fuel tank 42**.

Figure 3:
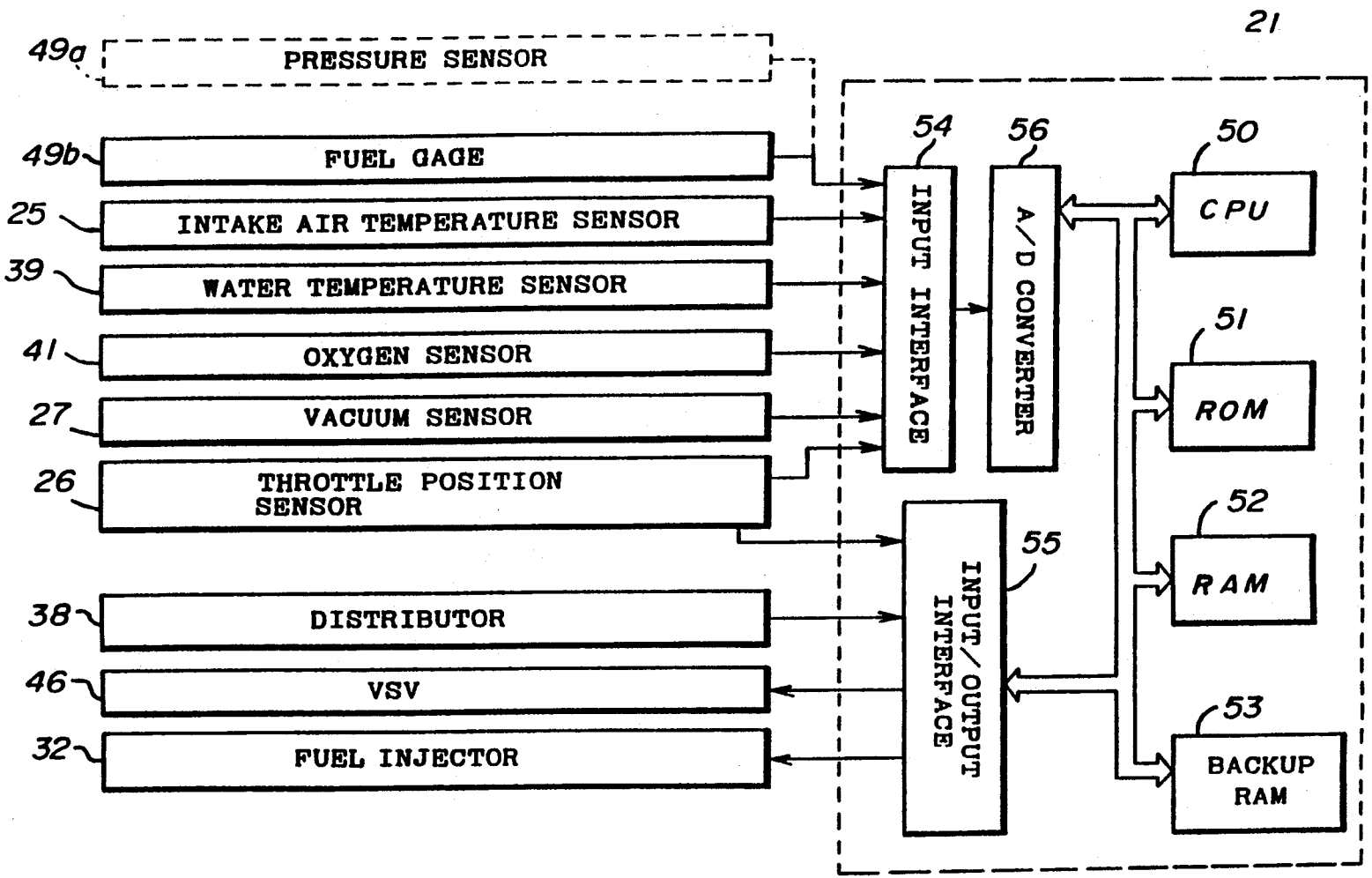
FIG. 3 is a block diagram for explaining a structure of a microcomputer used the evaporated fuel purge system shown in FIG. 2.

FIG. 3 shows a detailed structure of the microcomputer 21 shown in FIG. 2, which controls the operations of component parts of the evaporated fuel purge system shown in FIG. 2. In FIG. 3, those parts which are the same as those corresponding parts shown in FIG. 2 are designated by the same reference numerals, and a description thereof will be omitted. The microcomputer 21 shown in FIG. 3 includes a CPU (central processing unit) 50, a ROM (read-only memory) 51 in which control programs and two-dimensional maps are stored, a RAM (random access memory) 52 which is used as a working area, a backup RAM (random access memory) 53 for retaining necessary data even after the engine stops operation, an input interface circuit 54, an A/D (analog-to-digital) converter 56 provided with a multiplexer, an input/output interface circuit 55, and a bus 57 interconnecting the above mentioned components of the microcomputer 21.

The A/D converter 56 converts several input analog signals into digital signals and sends the respective digital signals to the CPU 50 via the bus 57. A signal indicative of the intake air temperature from the intake air temperature sensor 25, a signal indicative of the valve opening position of the throttle valve from the throttle position sensor 26, a signal indicative of the intake manifold air pressure (PM) from the vacuum sensor 27, a signal indicative of the cooling water temperature from the water temperature sensor 39, a signal indicative of the oxygen concentration from the oxygen sensor 41, and an output signal of the fuel gage 49*b* are supplied to the A/D converter 56 through the input interface 54.

The signal from the throttle position sensor 26 and a signal indicative of the rotating speed proportional to the engine speed (NE) from the distributer 38 are supplied to the input/output interface circuit 55, and signals are supplied by the input/output interface circuit 55 to the CPU 50 via the bus 57. Control signals from the CPU 50 are supplied by the input/output interface circuit 55 to the fuel injector 32 and the VSV 46, respectively, so that the operations of the fuel injector 32 and the VSV 46 are controlled. Especially, the fuel injection time TAU during which fuel is injected by the fuel injector 32 is adjusted by the control signal sent from the CPU 50.

The concentration detecting part 15, the malfunction discriminating part 16 and the purge cut time varying part 17, which are shown in FIG. 2, are achieved by executing several control routines, which will be described below, by means of the CPU 50 of the above described microcomputer 21 in accordance with the control programs stored in the ROM 51.

Next, a description will be given of a malfunction detecting procedure which is carried out in the first embodiment of the present invention. The malfunction detecting procedure which is performed by the microcomputer 21 includes a tentative malfunction discrimination routine, a purge cut time calculation routine, a diagnosis discrimination routine. These routines are executed in this sequence by the microcomputer 21, and in parallel to the execution of the above mentioned routines a VSV control routine is executed by the microcomputer 21. Therefore, a description will now be given of each of the above mentioned routines. [Tentative Malfunction Discrimination]

Figure 4A:
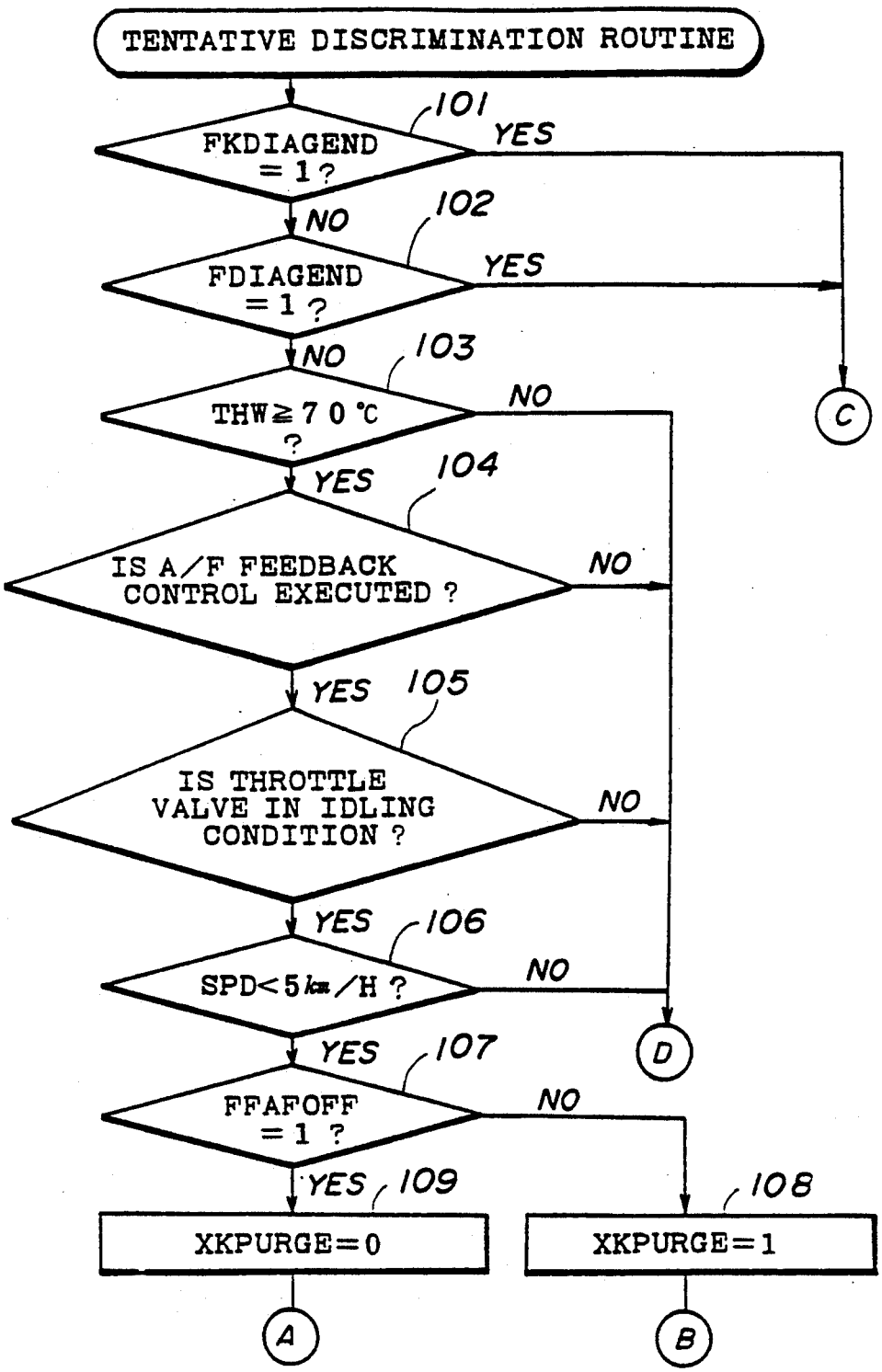
FIGS. 4A to 4C are flow charts for explaining a tentative malfunction discrimination routine which is performed in the first embodiment of the present invention.
Figure 4B:
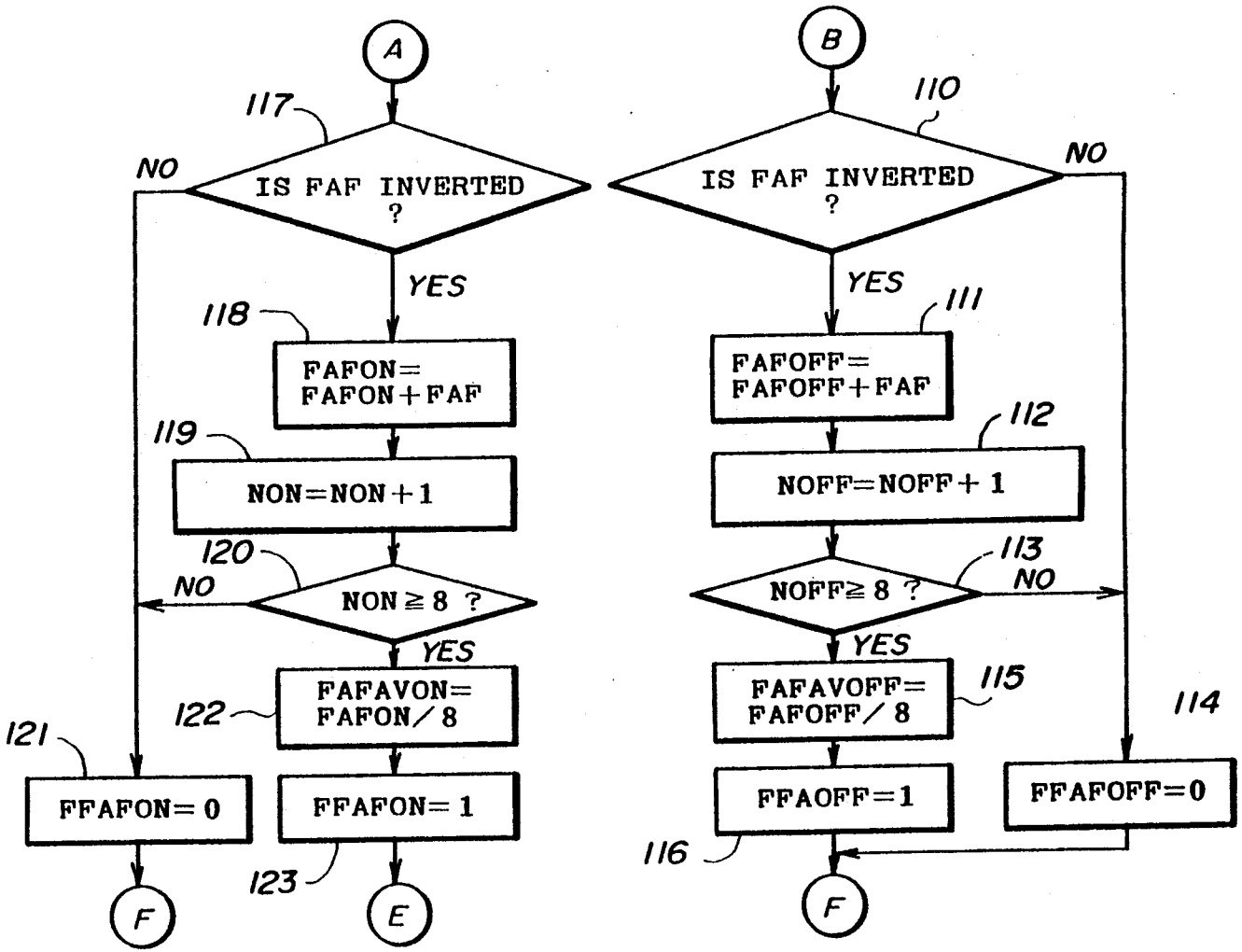
Figure 4C:
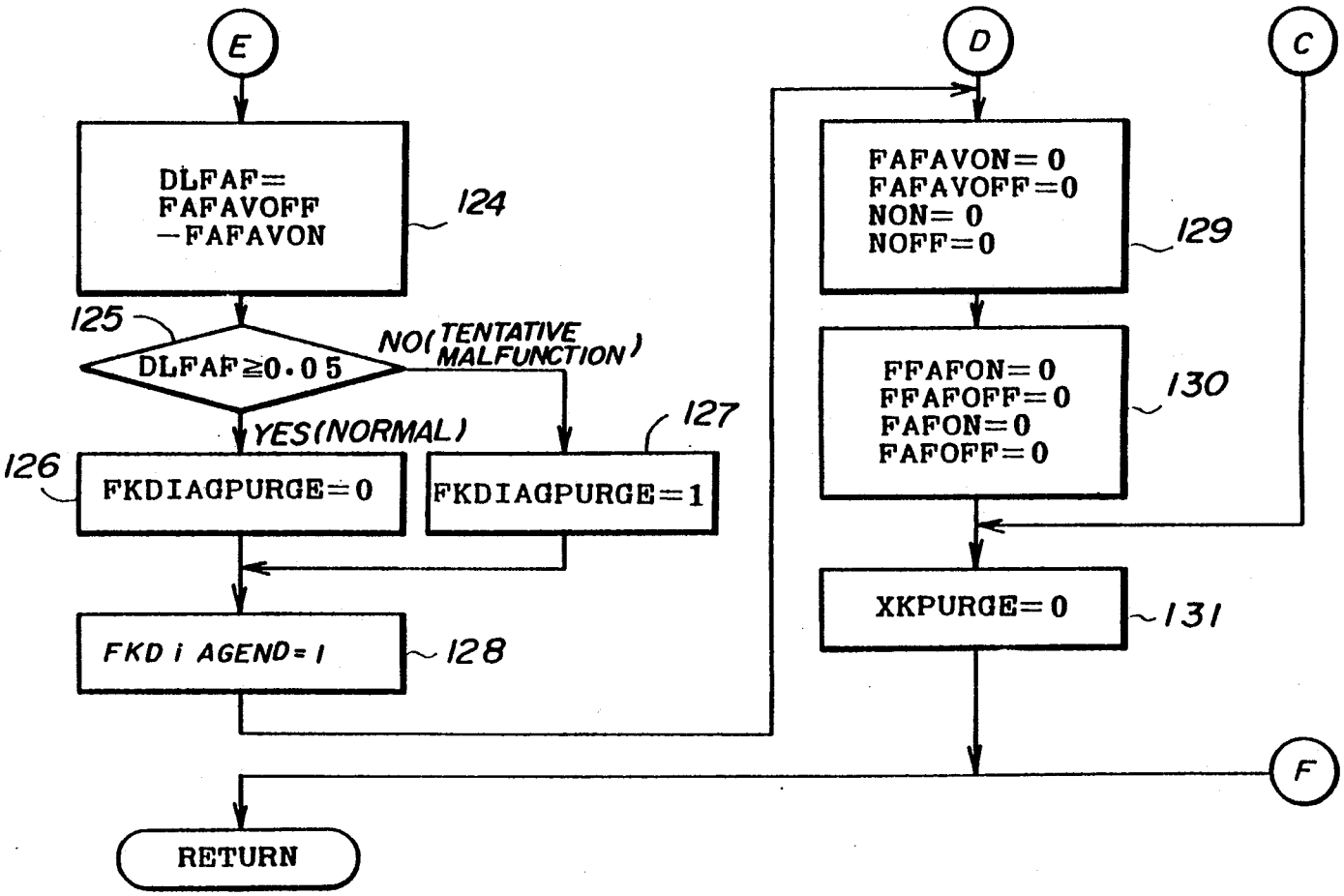

FIGS. 4A through 4C show a tentative malfunction discrimination routine. A step 101 of the flow chart shown in FIG. 4A makes a determination whether a tentative discrimination end check flag FKDiAGEND is equal to "1". This flag FKDiAGEND is previously set to "0" in an initialization routine (not shown). After the tentative discrimination routine is ended, the flag FKDiAGEND flag is set to "1". If it is determined in the step 101 that the flag FKDiAGEND is not equal to "1" (that is, the tentative discrimination routine is not yet ended.), then a step 102 makes a determination whether a diagnosis discrimination end check flag FDiAGEND is equal to "1". This flag FDiAGEND is previously set to "0" in the initialization routine. If either the step 101 determines that the tentative discrimination routine is ended, or the step 102 determines that the diagnosis discrimination routine is ended, then a step 131 shown in FIG. 4C sets a purge cutting mode flag XKPURGE to zero "0" so that the purging mode is performed, and the tentative discrimination routine is ended.

If the step 102 determines that the flag FDiAGEND is equal to zero "0", then steps 103 to 106 are performed sequentially. The step 103 determines whether the engine cooling water temperature THW indicated by an output signal of the water temperature sensor 39 is higher than 70 deg C. The step 104 determines whether the air-fuel ratio (A/F) feedback control routine is being performed. The step 105 determines whether the throttle valve 23 is in a fully closed condition (or in idling condition) on the basis of an output signal of the throttle position sensor 26. The step 106 determines whether the vehicle speed SPD indicated by an output signal of a vehicle speed sensor (not shown) is not higher than 5 km/hour. The conditions, which are checked in the steps 103 to 106, are the requirements for the operations of the evaporated fuel purge system allowing the A/F feedback correction factor FAF to have appropriate values safely.

If all the requirements in the steps 103 to 106 are met, then a step 107 determines whether a FAF average value calculation check flag FFAFOFF for the purge cutting mode is equal to "1". The check flag FFAFOFF when it is set to "0" shows that the FAF average value is not yet calculated. If the step 107 determines that the flag FFAFOFF is not equal to "1", then a step 108 sets the flag XKPURGE to "1" so that the purge cutting mode is performed. The check flag FFAFOFF when it is set to "1" shows that the FAF average value has been calculated. If the step 107 determines that the flag FFAFOFF is equal to "1", then a step 109 sets the flag XKPURGE to "0" so that the purge cutting mode is ended and the purging mode is performed. If any of the requirements in the steps 103 to 106 is not met, then steps 129 to 131 in FIG. 4C are performed so that several flags, which will be described below, are set to zero "0".

When the flag XKPURGE is set to "1" in the step 108 so that the purge cutting mode is performed, a step 110 in FIG. 4B determines whether the A/F feedback correction factor FAF is changed from a lean-side range value to a rich-side range value or vice versa. This change in the factor FAF is called hereinafter the FAF inversion. If the factor FAF is not inverted, then a step 114 sets the flag FFAFOFF to zero "0" and the tentative discrimination routine is ended. If the step 110 determines that the factor FAF is inverted, then a step 111 renews the FAF integrating value FAFOFF for the purge cutting mode by adding the current FAF value, when the purge cutting is currently performed, to the previous FAFOFF value (FAFOFF=FAFOFF+FAF). And, a step 112 increments a data count value NOFF for the purge cutting mode (NOFF=NOFF+1), and a step 113 determines whether the value of the data count value NOFF is equal to or greater than 8.

If the value of NOFF is smaller than 8, then the step 114 sets the flag FFAFOFF to zero "0" and the routine is ended. If the value of NOFF is equal to or greater than 8, then a step 115 calculates the FAF average value FAFAVOFF for the purge cutting mode by dividing the FAF integrating value FAFOFF by 8 (FAFAVOFF=FAFOFF/8), and a step 116 sets the flag FFAFOFF to "1".

On the other hand, when the flag XKPURGE is set to "0" in the step 109 so that the purging mode is performed, a step 117 in FIG. 4B determines whether the A/F feedback correction factor FAF is inverted or not. If the FAF value is inverted, then steps 118 to 123 are performed in a similar manner to the steps 111 to 116, so that the FAF average value FAFAVON for the purging mode is calculated and the check flag FFAFON is set to "1". If the FAF value is not inverted, then the step 121 sets the flag FFAFON to zero "0" and the routine is ended. If the step 123 sets the flag FFAFON to "1", then a step 124 shown in FIG. 4C calculates a difference DLFAF between the FAF average value FAFAVOFF when the the purge cutting is performed and the FAF average value FAFAVON when the purging is performed (DLFAF=FAFAVOFF−FAFAVON).

Figure 5:
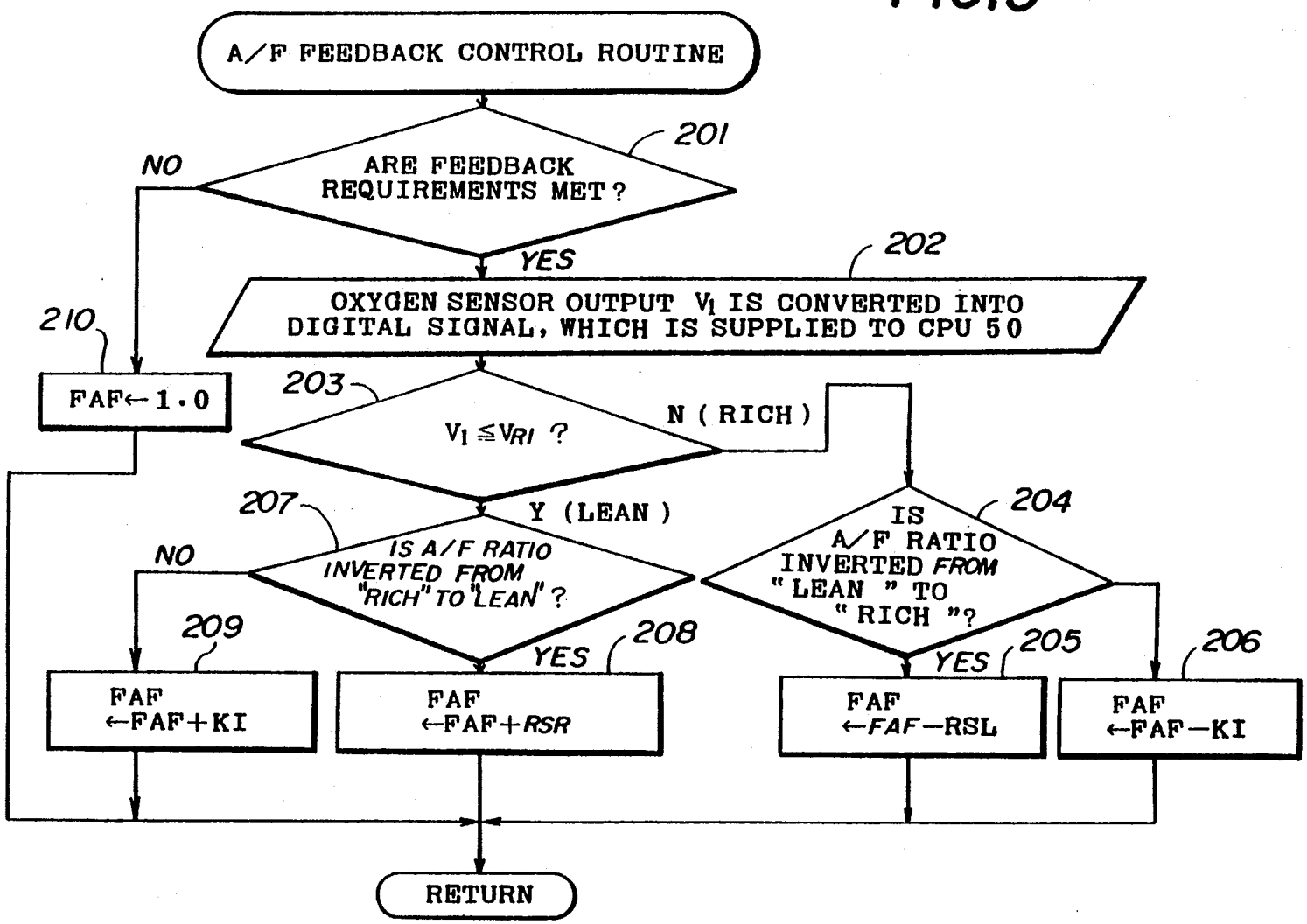
FIG. 5 is a flow chart for explaining an air-fuel ratio feedback control routine which is performed in the evaporated fuel purge system.

In the meantime, FIG. 5 shows a known air-fuel ratio (A/F) feedback correction control routine in which the air-fuel ratio feedback correction factor FAF is calculated. This A/F feedback correction control routine is started at time intervals of, for example, 4 msec, and the following procedure is performed by the microcomputer 21. A step 201 in the flow chart shown in FIG. 5 makes a determination whether the feedback requirements for the A/F feedback correction control routine to be started are met or not. The feedback requirements includes, for example, 1) the engine cooling water temperature is higher than a predetermined reference level, 2) the engine is not in the starting condition, 3) the fuel supply is not increased after the engine is started, 4) the engine is not in the idling condition, 5) the engine is not in the load condition, and 6) the engine is not in the fuel cut condition. If any of the feedback requirements is not met, then a step 210 sets the A/F feedback correction factor FAF to "1.0" and the VSV control routine is ended. In this manner, an open-loop A/F feedback control is carried out.

If all the feedback requirements are met, then a step 202 converts a signal indicative of an output voltage V1 of the oxygen sensor 41 into a digital signal and this digital signal is supplied to the CPU 50. A step 203 determines whether the output voltage V1 is equal to or lower than a predetermined reference level Vr1. The voltage V1 which is higher than the reference level Vr1 shows that the air-fuel mixture is rich, while the voltage V1 which is lower than the reference level Vr1 shows that the air-fuel mixture is lean. If the air-fuel mixture is rich (V1>Vr1), then a step 204 determines whether the air-fuel ratio (A/F) is inverted from a "lean" range value to a "rich" range value. If the A/F is inverted, then a step 205 calculates the current value of the A/F feedback correction factor FAF by subtracting a constant value RSL from the previous FAF value (FAF←FAF−RSL) and the VSV control routine is ended. If the A/F is not inverted but was previously in the "rich" range and currently remains in the "rich" range, then a step 206 calculates the current value of the FAF by subtracting an integral constant KI from the previous FAF value (FAF←FAF−KI), and the routine is ended.

If the step 203 determines that the air-fuel mixture is lean (V1≦Vr1), then a step 207 determines whether the air-fuel ratio (A/F) is inverted from a "rich" range value to a "lean" range value. If the A/F is inverted, then a step 208 calculates the current value of the FAF by adding a constant value RSR to the previous FAF value (FAF←FAF+RSR) and the VSV control routine is ended. If the A/F is not inverted but was previously in the "lean" range and currently remains in the "lean" range, then a step 209 calculates the current value of the FAF by adding an integral constant KI to the previous FAF value (FAF←FAF+KI), and the routine is ended. The above mentioned constant values RSL and RSR are predetermined as being considerably greater than the integral constant KI.

Figure 6:
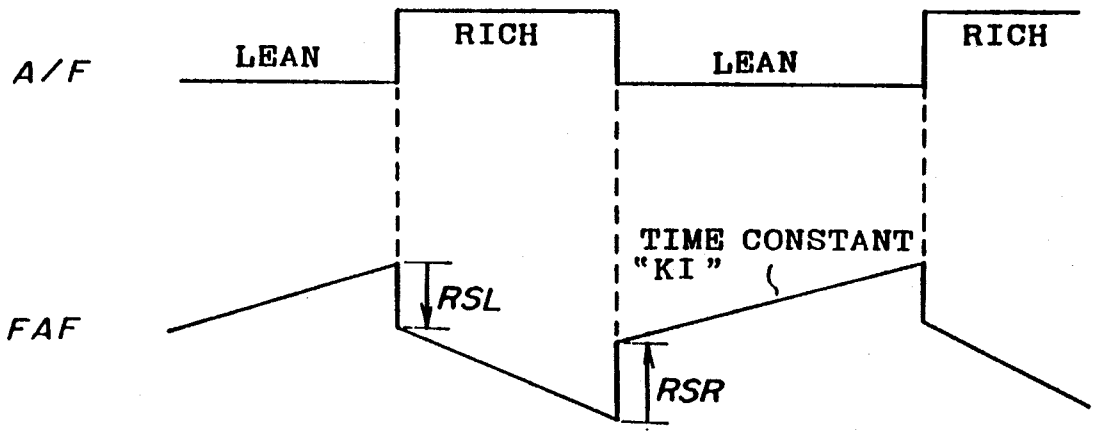
FIG. 6 is a diagram for explaining changes in the feedback correction factor FAF with respect to changes in the air-fuel ratio A/F which are used in the air-fuel ratio feedback control routine.

FIG. 6 schematically shows the changes in the FAF factor with respect to the changes in the A/F ratio. When the A/F ratio is inverted from a "lean" range value to a "rich" range value, the FAF value is decreased considerably by the constant value RSL so that the fuel injection time TAU is changed to a smaller value, as shown in FIG. 6. When the A/F ratio is inverted from a "rich" range value to a "lean" range value, the FAF value is increased considerably by the constant value RSR so that the fuel injection time TAU is changed to a greater value. In a case in which the A/F ratio is not inverted, the FAF value is gradually changed depending on the integral constant (or a time constant) KI. When the A/F ratio is continuously in a "lean" range, the FAF value is gradually increased depending on the constant KI. When the A/F ratio is continuously in a "rich" range, the FAF value is gradually decreased depending on the constant KI. As in the foregoing, the A/F feedback correction factor FAF is calculated. The FAF factor is controlled so that the fuel injection time TAU is determined by multiplying a basic fuel injection time by other several factors to control the intake air-fuel mixture as being at the target air-fuel ratio. The basic fuel injection time is determined depending on the engine speed and the intake manifold vacuum pressure.

Figure 7:
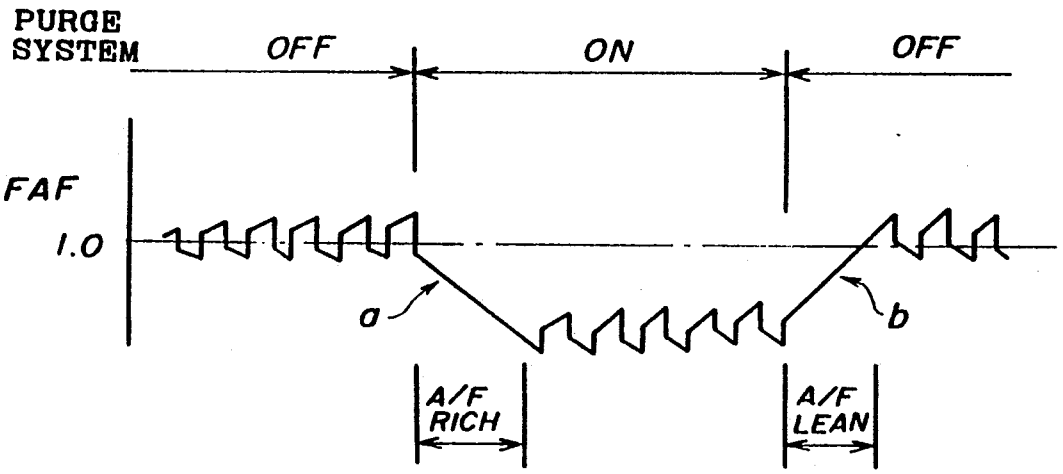
FIG. 7 is a diagram for explaining changes in the FAF when the evaporated fuel purge system is switched ON and OFF.

Using the thus calculated FAF factor, a step 125 in the flow chart shown in FIG. 4C performs a tentative malfunction discrimination so that it is tentatively determined whether there is a malfunction in the evaporated fuel purge system. In a case in which the evaporated fuel purge system operates normally and there is no malfunction, the adsorbed fuel vapor in the adsorbent in the canister 44 is purged into the intake passage through the purge passage 45 and the VSV 46 when the purging mode is performed by switching the VSV 46 ON, and the air-fuel ratio A/F of the intake mixture being fed to the engine is changed and deviates from the target air-fuel ratio to a "rich" range depending on the amount of fuel vapor purged. In order to correct the deviation of the A/F ratio of the intake mixture, the FAF factor is decreased to a "lean" range as indicated by an arrow "a" in FIG. 7. When the purge cutting is performed by switching the VSV 46 OFF, the air-fuel ratio A/F of the intake mixture to the engine is changed and deviates from the target air-fuel ratio to a "lean" range depending on the purge cut time period during which the purge cutting is performed. In order to correct the deviation of the A/F ratio of the intake mixture, the FAF factor is increased to a "rich" range as indicated by an arrow "b" in FIG. 7.

After the step 124 in FIG. 4C is performed, the step 125 performs a tentative malfunction discrimination so that it is determined whether the difference DLFAF between the FAF average value FAFAVOFF at a time when the purge cutting is performed and the FAF average value FAFAVON at a time when the purging is performed (DLFAF=FAFAVOFF−FAFAVON) is equal to or greater than 0.05. If the difference DLFAF is equal to or greater than 0.05 (that is, it is tentatively determined that the evaporated fuel purge system is operating normally with no malfunction), then a step 126 sets a tentative discrimination flag FKDiAGPURGE to zero "0". If the difference DLFAF is not greater than 0.05 (that is, it is tentatively determined that there is a malfunction in the evaporated fuel purge system, then a step 127 sets the the tentative discrimination flag FKDiAGPURGE to "1".

After either the step 126 or the step 127 is performed, a step 128 sets the tentative discrimination end check flag FKDiAGEND to "1". Then, as described above, in the step 129, the FAF average value FAFAVON when the purging mode is performed, the FAF average value FAFAVOFF when the purge cutting mode is performed, the data count value NON when the purging mode is performed and the data count value NOFF when the purge cutting mode is performed are all set to zero "0". In the step 130, the FAF average value calculation check flag FFAFON for the purging mode, the FAF average value calculation check flag FFAFOFF for the purge cutting mode, the FAF integrating value FAFON for the purging mode and the FAF integrating value FAFOFF for the purge cutting mode are all set to zero "0". And, in the step 131, the purge cutting mode flag XKPURGE to zero "0", and the tentative malfunction discrimination routine is ended.

As described above, the tentative malfunction discrimination routine shown in FIGS. 4A to 4C is performed after the initialization routine is ended, only when either the tentative discrimination or the diagnosis routine is not performed. This tentative malfunction discrimination is performed by checking if the change DLFAF in the FAF average value from a time when the purge cutting is performed to a time when the purging is performed immediately after the purge cutting mode is ended is equal to or greater than 0.05. Purge Cut Time Calculation.

Figure 8:
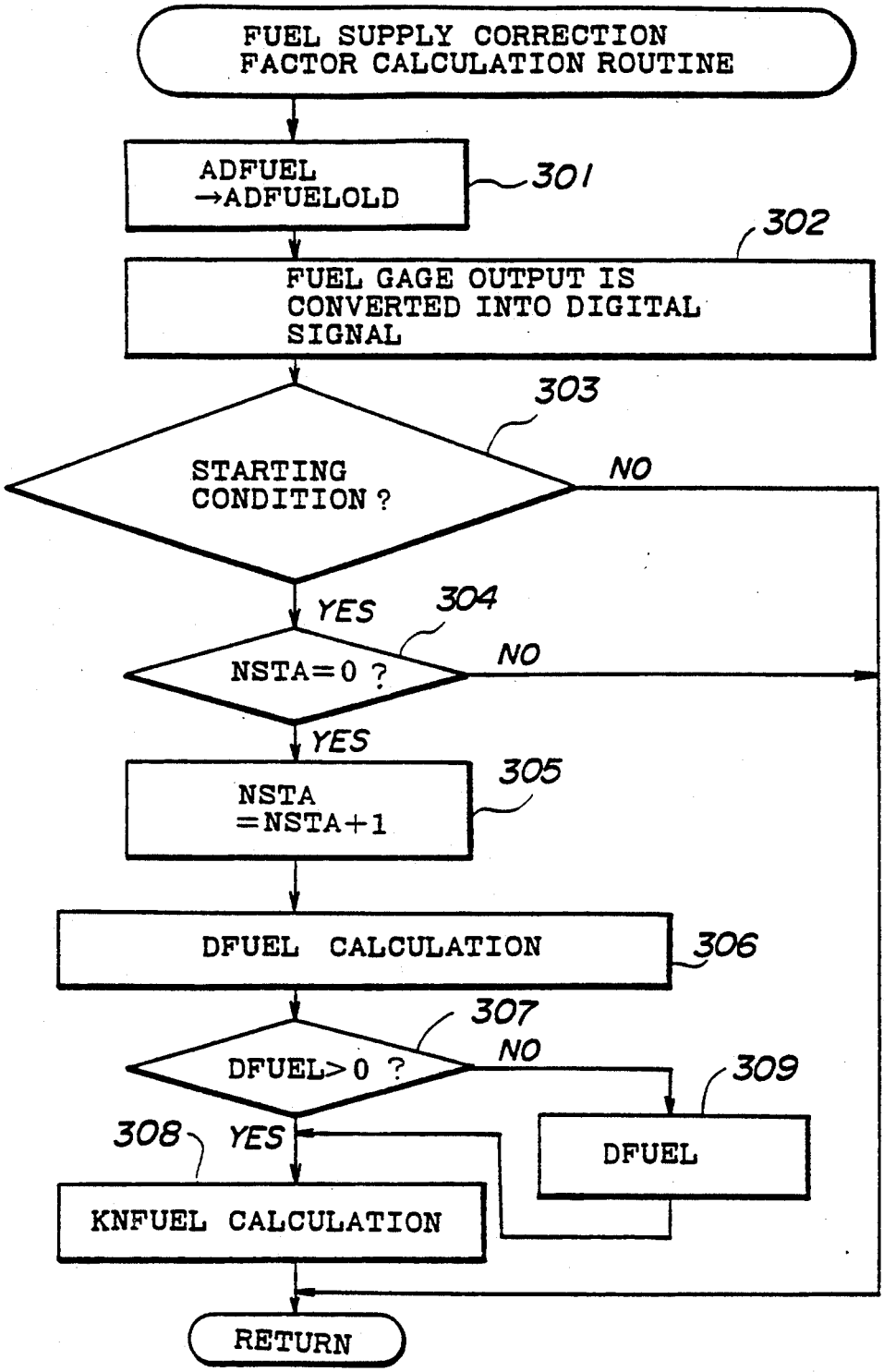
FIG. 8 is a flow chart for explaining a fuel supply correction factor calculation routine used in the first embodiment of the present invention.
Figure 9:
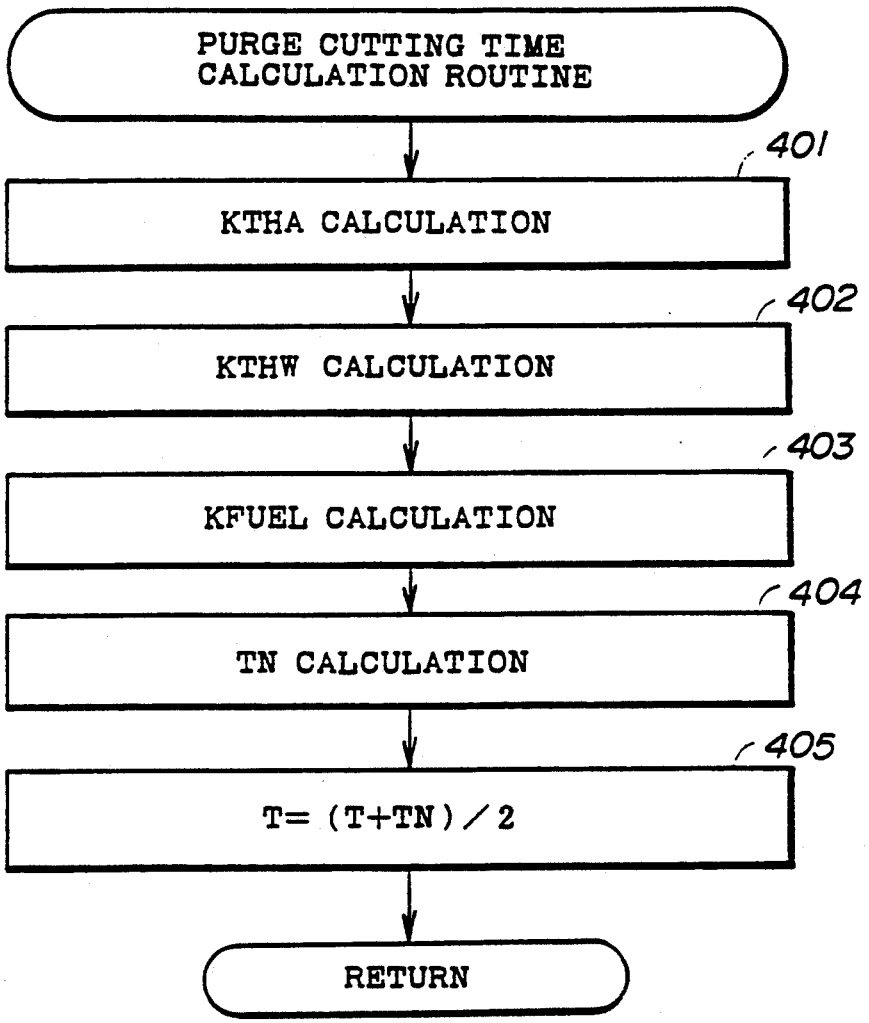
FIG. 9 is a flow chart for explaining a purge cutting time calculation routine used in the first embodiment.
Figure 10:
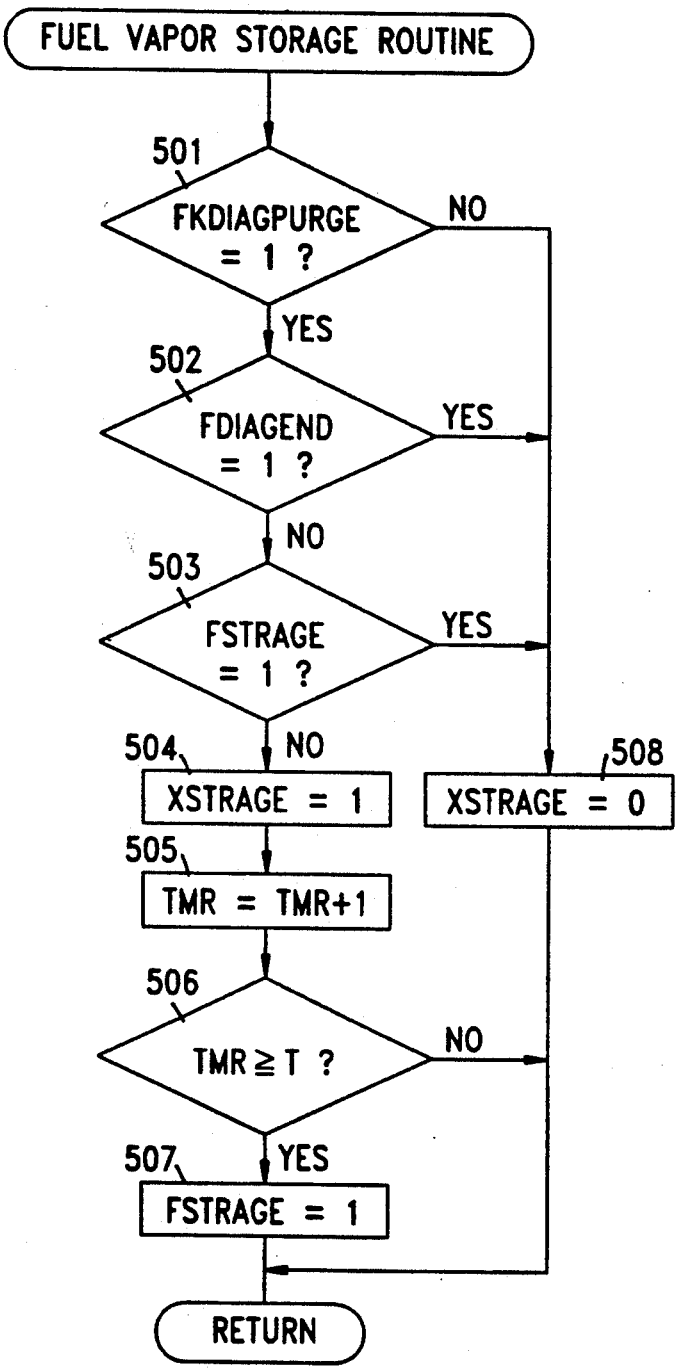
FIG. 10 is a flow chart for explaining a fuel vapor storage routine used in the first embodiment.

FIGS. 8, 9 and 10 show, respectively, a fuel supply correction factor calculation routine, a purge cut time calculation routine and a fuel vapor storage routine, which are related to the purge cut time control procedure as the essential part of the present invention.

In the flow chart of the fuel supply correction factor calculation routine shown in FIG. 8, a step 301 allows the CPU 50 in the microcomputer 21 to read out from the backup RAM 53 a digital signal ADFUEL indicating the previous value of the fuel vapor pressure in the fuel tank immediately after the engine is started, and this signal ADFUEL is transferred to a variable ADFUELOLD. The digital signal ADFUEL having been stored in the backup RAM 53 is a digital signal into which an output signal of the fuel gage **49*b* mounted on the fuel tank has been converted. A step 302 supplies the output signal of the fuel gage 49*b*, indicating the current value of the fuel vapor pressure in the fuel tank, to the A/D converter 56 and supplies a converted digital signal ADFUEL from the A/D converter 56 to the CPU 50. A step 303 determines whether the engine is in the starting condition on the basis of the rotating speed indicated by an output signal of the distributor 38. If the engine is in the starting condition, then a step 304 determines whether a count value NSTA is equal to zero. This count value NSTA is previously set to zero in a initialization routine. The count value NSTA is equal to zero initially after the step 303 has determined that the engine is in the starting condition, and in the step 304, it is usually determined that the count value NSTA is equal to zero. Next, a step 305 increments the count value NSTA by 1, and a step 306** calculates a fuel supply amount factor DFUEL from the following formula:

$$DFUEL=(ADFUEL-ADFUELOLD)/ADFULL.$$

In the above formula, ADFULL is a given constant value which is indicated by an output signal of the fuel gage **49*b* when the fuel tank 42** is fully filled with fuel.

A step 307 determines whether the value of the thus calculated fuel supply amount factor DFUEL is greater than zero "0". The factor DFUEL which is greater than 0 shows that a certain amount of fuel has been supplied. If the fuel supply amount factor DFUEL is greater than 0, then a step 308 calculates a fuel supply correction factor KNFUEL on the basis of a two-dimensional map shown in FIG. 11D, previously stored in the ROM 51, using the calculated fuel supply amount factor DFUEL. On the other hand, the fuel supply amount factor DFUEL which is equal to or smaller than zero shows that no fuel has been supplied. If the DFUEL is not greater than zero, then a step 309 sets the DFUEL to zero and the step 308 is performed so that the fuel supply correction factor KNFUEL is calculated.

Figure 11A:
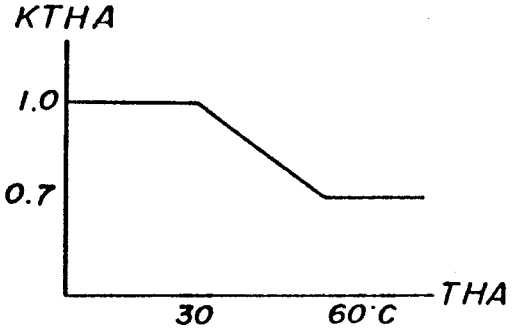
FIGS. 11A through 11D are diagrams for explaining two-dimensional maps for calculating factors KTHA, KTHW, KFUEL and KNFUEL which are shown in FIGS. 8 and 9.
Figure 11B:
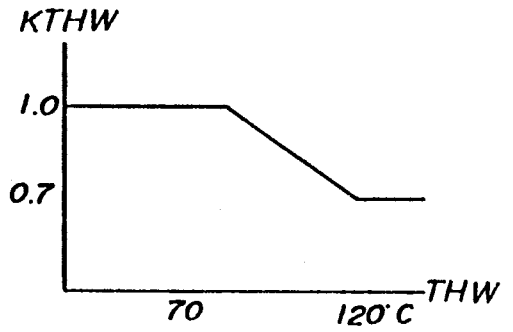
Figure 11C:
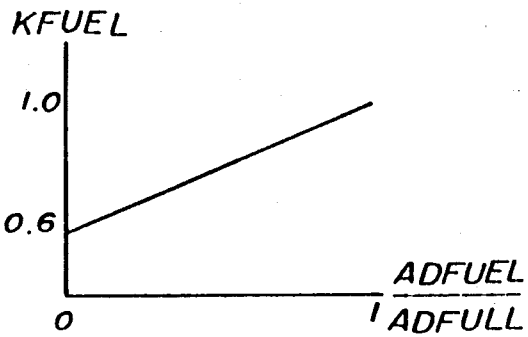
Figure 11D:
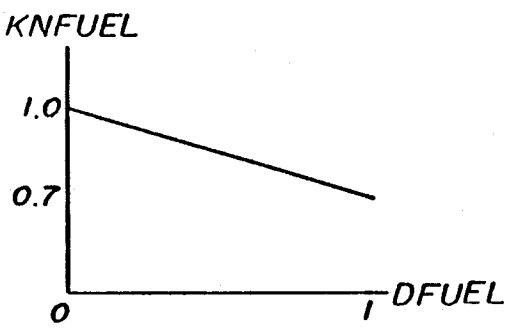

As is apparent from FIG. 11D, the fuel supply correction factor KNFUEL is equal to 1.0 (the maximum) when DFUEL=0, and is changed in inverse proportion to the fuel supply amount factor DFUEL. This is because the purge cut time T must be changed to a smaller value, as the amount of fuel supplied becomes greater and the amount of fuel vapor evaporated in the fuel tank becomes greater. After the fuel supply correction factor KNFUEL is calculated in the step 308, the fuel supply correction factor calculation routine is ended. When the step 303 determines that the engine is not in the starting condition, or when the step 304 determines in the second or subsequent occasions that the count value NSTA is not equal to 0, the fuel supply correction factor KNFUEL is not calculated and the routine is ended. Since the steps 302 and 302 are performed each time the fuel supply correction factor calculation routine is performed, an output signal of the fuel gage **49*b*** immediately before the engine stops operation is stored in the digital signal ADFUEL.

In the flow chart of the purge cut time calculation routine shown in FIG. 9, a step 401 calculates an intake air temperature correction factor KTHA through the interpolation method on the basis of a two-dimensional map as shown in FIG. 11A, using a digital value THA indicated by an output signal of the intake air temperature sensor 25. The two-dimensional map in FIG. 11A is also previously stored in the ROM 51. The A/D converter 56 converts the output signal of the intake air temperature sensor 25 into the digital value THA. As is apparent from the two-dimensional map shown in FIG. 11A, the intake air temperature correction factor KTHA is predetermined such that the value of the KTHA becomes smaller when the intake air temperature is higher. This is because the purge cut time T must be changed to a smaller value, as the intake air temperature becomes higher and the amount of fuel vapor evaporated in the fuel tank becomes greater.

Similarly, a step 402 calculates a cooling water temperature correction factor KTHW through the interpolation method on the basis of a two-dimensional map as shown in FIG. 11B, using a digital value THW indicated by an output signal of the water temperature sensor 39. The cooling water temperature correction factor KTHW as given in the two-dimensional map in FIG. 11B is predetermined such that the value of the KTHW is in inverse proportion to the cooling water temperature THW within a range between 70 deg C. and 120 deg C. This is because the purge cut time T must be changed to a smaller value, as the fuel temperature becomes higher and the amount of fuel vapor evaporated in the fuel tank becomes greater when the cooling water temperature THW becomes higher.

A step 403 calculates a fuel amount correction factor KFUEL through the interpolation method on the basis of a two-dimensional map as shown in FIG. 11C, using the ratio of a digital value ADFUEL (for the current fuel gage output) to the digital value ADFULL (for the given fuel gage output when the fuel tank is fully filled with fuel). When the amount of the residual fuel in the fuel tank is smaller (in other words, the ratio of the ADFUEL to the ADFULL becomes nearer to 0), the fuel vapor is more easily evaporated in the fuel tank. Therefore, the purge cut time T must be changed to a smaller value, as the ratio of the ADFUEL to the ADFULL becomes nearer to 0.

A step 404 calculates the basic purge cut time TN by the following formula:

$$TN=30\times KTHA\times KTHW\times KFUEL\times KNFUEL$$

In the above formula, "30" is a given constant which is determined by considering the time required for the necessary amount of fuel vapor, for making an accurate malfunction discrimination, to be adsorbed in the adsorbent in the canister 44. However, another constant different from the above constant "30" must be applied to the respective vehicle models, because the necessary amount of fuel vapor adsorbed in the adsorbent in the canister for making an accurate malfunction discrimination is varied depending on the fuel tank capacity, the fuel fuel tank shape and the vehicle type. Also, in the above formula, "KNFUEL" is the fuel supply correction factor which has been calculated in the step 308 shown in FIG. 8.

A step 405 renews the purge cut time T by calculating the average value of the previous purge cut time T and the currently calculated basic purge cut time TN from the formula: $T=(T+TN)/2$, and stores the renewed purge cut time T in the RAM 52. Since the operating conditions of the vehicle are varied every second, it is necessary to renew the purge cut time T in this manner.

In the flow chart of the fuel vapor storage routine shown in FIG. 10, a step 501 makes a determination whether the tentative discrimination flag FKDiAGPURGE is equal to "1" or not. When the flag FKDiAGPURGE has been set to "1" it is tentatively determined that there is a malfunction, while when the flag FKDiAGPURGE has been set to "0" it is tentatively determined that there is no malfunction. If the step 501 determines that the flag FKDiAGPURGE is equal to "1", then a step 502 determines whether the diagnosis discrimination end check flag FDiAGEND is equal to "1". The flag FDiAGEND which has been set to "1" means that the diagnosis discrimination routine is ended. If the step 502 determines that the flag FDiAGEND is not equal to "1", then a step 503 determines whether a fuel vapor storage check flag FSTRAGE is equal to "1". The flag FSTRAGE which has been set to "1" instructs the CPU 50 that fuel vapor evaporated in the fuel tank 42 be adsorbed in the adsorbent in the canister 44, and is previously set to zero "0" in the initialization routine.

If the step 503 determines that the flag FSTRAGE is not equal to "1" but set to "0". then a step 504 sets the purge cutting mode flag XSTRAGE to "1" and a step 505 increments a timer count value TMR by 1 ($TMR=TMR+1$). And, a step 506 determines whether the timer count value TMR is equal to or greater than the purge cut time period T calculated in the step 405 in FIG. 9. If the count value TMR is smaller than the calculated time period T, then the fuel vapor storage routine is ended. If the count value TMR is equal to or greater than the calculated purge cut time period T, then a step 507 sets the flag FSTRAGE to "1" and the routine shown in FIG. 10 is ended.

If the step 501 determines that the flag FKDiAGPURGE is not equal to "1", or if the step 502 determines that the flag FDiAGEND is equal to "1", or if the step 503 determines that the flag FSTRAGE is equal to "1", the checking of the timer count value TMR is not performed and a step 508 sets the purge cutting mode flag XSTRAGE to "0" then the fuel vapor storage routine is ended.

Figure 12A:
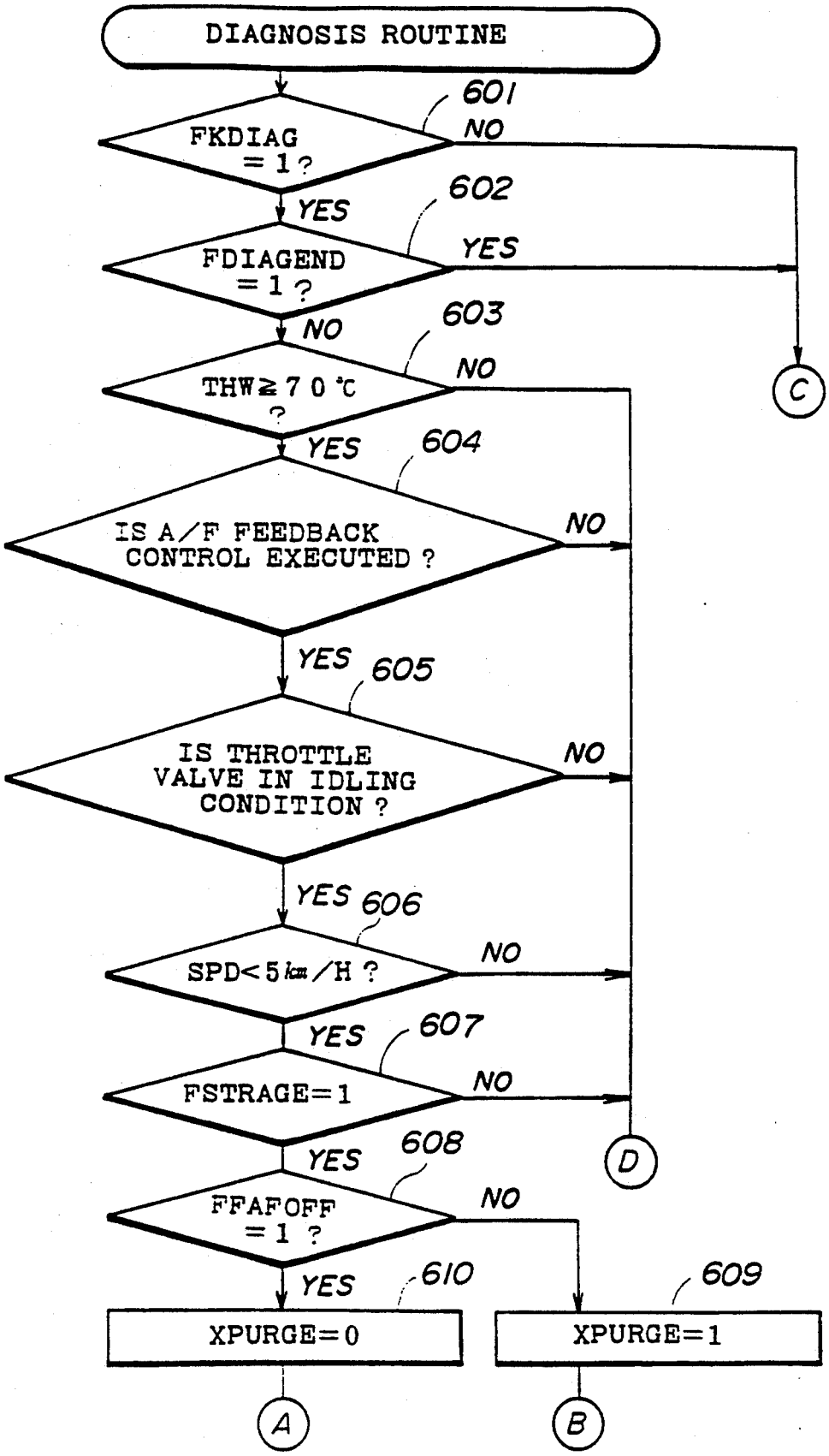
FIGS. 12A through 12C are flow charts for explaining a diagnosis routine which is performed in the first embodiment of the present invention.
Figure 12B:
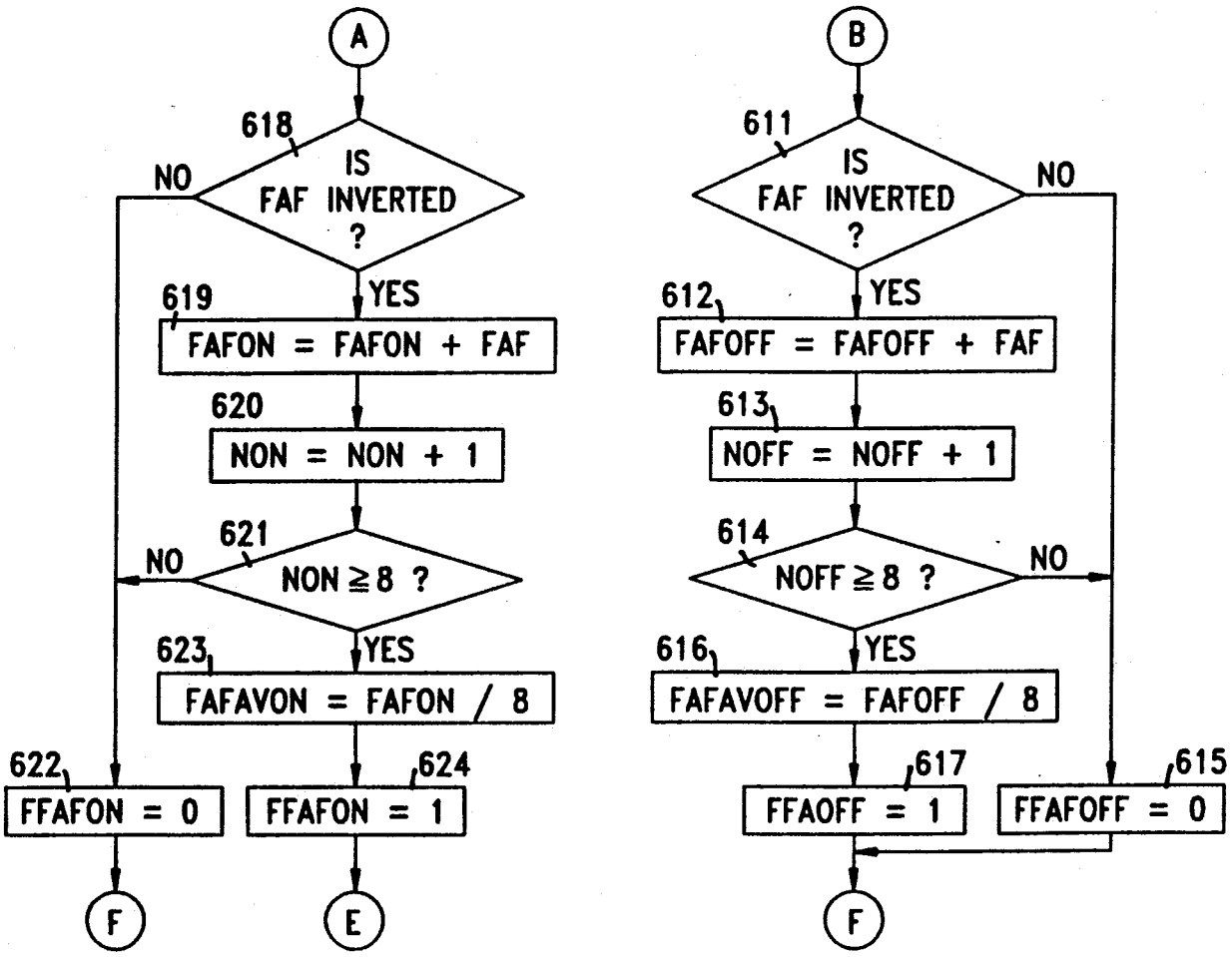
Figure 12C:
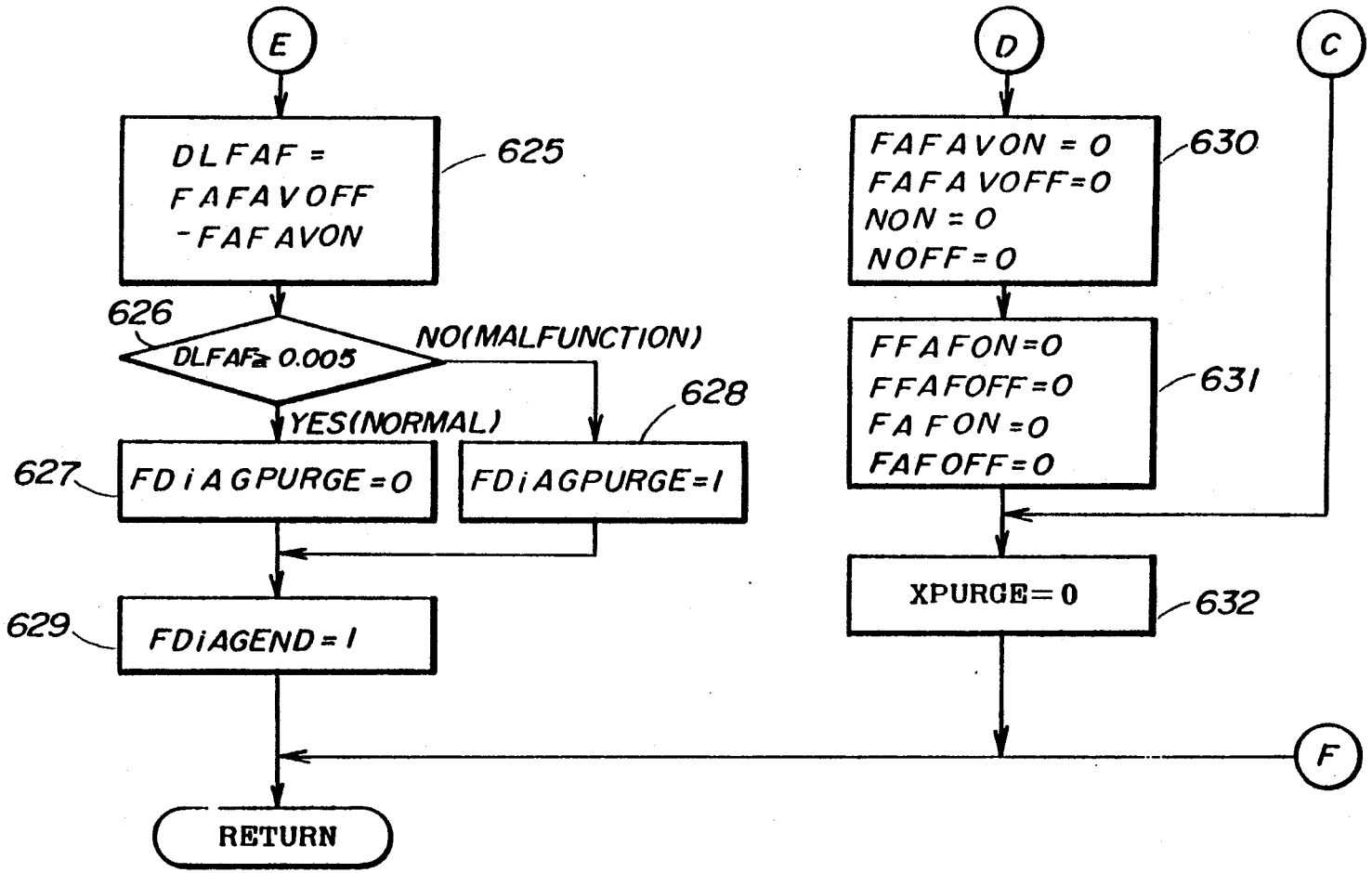

In the fuel vapor storage routine shown in FIG. 10, the flag XSTRAGE is set to "1" for the purge cut time period T so that the purge cutting mode is performed, only when the tentative discrimination routine shown in FIGS. 4A to 4C determines that there is a malfunction and when the diagnosis discrimination routine shown in FIGS. 12A to 12C is not yet performed. As described above, the purge cut time period T is calculated such that the purge cut time period T is made as being a smaller value because the tendency of fuel in the fuel tank to evaporate is relatively great when 1) the fuel supply amount is relatively great, 2) the fuel temperature is relatively high (the intake air temperature or the engine cooling water temperature is high) and 3) the residual fuel amount is relatively small. The purge cut time varying part 17 can be achieved by performing the above described routines shown in FIGS. 8 to 10.

Diagnosis Discrimination

FIGS. 12A through 12C show the diagnosis discrimination routine which is performed in the first embodiment of the present invention. This diagnosis discrimination routine is essentially the same as the tentative discrimination routine shown in FIGS. 4A through 4C. In the flow chart shown in FIG. 4A, a step 601 determines whether the flag FKDiAGPURGE is equal to "1" in order to check if it is tentatively determined in the step 125 shown in FIG. 4C that there is a malfunction. If the step 601 determines that the flag FKDiAGPURGE is equal to "1", then a step 602 determines whether the flag FDiAGEND is equal to "1" in order to check if the diagnosis discrimination routine has been ended. If the step 601 determines that the flag FKDiAGPURGE is equal to "0" (which indicates that there is no malfunction), or if the step 602 determines that the flag FDiAGEND is equal to "1" (which indicates that the diagnosis discrimination is ended), then a step 632 shown in FIG. 12C sets the purge cutting mode flag XPURGE to zero "0" and the routine is ended.

Steps 603 through 606 shown in FIG. 12A are the same as the steps 103 through 16 shown in FIG. 4A, and these steps 603 to 606 determine whether the requirements for the evaporated fuel purge system are met in order to check if the system is in operating conditions in which an appropriate value of the FAF factor can be obtained stably, then a step 607 determines whether the flag FSTRAGE is equal to "1". The flag FSTRAGE is set to "1" in the step 507 shown in FIG. 10 after the purge cutting mode has been performed for the purge cut time period T. If the step 607 determines that the flag FSTRAGE is equal to "1", then a step 608 determines whether the FAF average value calculation check flag FFAFOFF for the purge cutting mode is equal to "1". When the step 608 determines that the flag FFAFOFF is equal to "0", the FAF average value in the purge cutting mode is not calculated, and therefore a step 609 sets the flag XPURGE to "1" in order to instruct the purge part 14 to perform the purge cutting mode. When the flag FFAFOFF is equal to "1", the FAF average value in the purge cutting mode is calculated, and therefore a step 610 sets the flag XPURGE to "0" in order to instruct the purge part 14 to perform the purging mode.

In a case in which the step 608 sets the flag XPURGE to "1", the procedure including steps 611 to 617 shown in FIG. 12B, which is essentially the same as the procedure including the steps 110 to 116 shown in FIG. 4B, calculates the FAF average value FAFAVOFF in the purge cutting mode when the A/F feedback correction factor FAF is "inverted" eight times, and sets the flag FFAFOFF to "1" after the calculation is performed. On the other hand, in a case in which the step 610 sets the flag XPURGE to "0", the procedure including steps 618 to 624 shown in FIG. 12B, which is essentially the same as the procedure including the steps 117 to 123 shown in FIG. 4B, calculates the FAF average value FAFAVON in the purging mode when the A/F feedback correction factor FAF is "inverted" eight times, and sets the flag FFAFON to "1" after the calculation is performed.

When any of the steps 615, 617 and 622 is performed, the diagnosis discrimination routine is ended. When the step 624 is performed, a step 625 shown in FIG. 12C calculates a difference DLFAF between the FAF average value FAFAVOFF when the the purge cutting is performed and the FAF average value FAFAVON when the purging is performed (DLFAF=-FAFAVOFF−FAFAVON ). And, as described above, a step 626 makes a diagnosis discrimination by determining whether the difference DLFAF is greater than 0.05.

When the step 626 determines that the difference DLFAF is greater than 0.05, it is discriminated that the evaporated fuel purge system has no malfunction and operates normally, and then a step 627 sets the diagnosis discrimination flag FDiAGPURGE to zero "0" and a step 629 sets the flag FDiAGEND to "1" and then the routine is ended. On the other hand, when the step 626 determines that the difference DLFAF is not greater than 0.05, in other words, when it is determined in both the tentative discrimination routine and the diagnosis discrimination routine that there is a malfunction in the evaporated fuel purge system, a step 628 sets the flag FDiAGPURGE to "1". When the flag FDiAGPURGE is set to "1" in the step 628, the CPU 50 switches ON the warning lamp 47 shown in FIG. 2 in order to give a warning of the malfunction in the evaporated fuel purge system to a driver in the vehicle. Then, the step 629 is performed and the routine is ended.

When any of the requirements in the steps 603 to 606 shown in FIG. 12A is not met, or when the step 607 determines that the flag FSTRAGE is equal to "0", a step 630 shown in FIG. 12C is performed. In the step 630, the FAF average value FAFAVON when the purging is performed, the FAF average value FAFAVOFF when the purge cutting is performed, the count value NON for the purging mode and the count value NOFF for the purge cutting mode are all set to zero "0". Next, in a step 631, the above described flags FFAFON, FFAFOFF, and the FAF integrating values FAFON, FAFOFF are all set to zero. Finally, the step 632 sets the purge cutting mode flag XPURGE to "0", and the routine is ended.

Thus, the concentration detecting part 15 and the malfunction discriminating part 16 according to the present invention can be achieved by performing the diagnosis discrimination routine shown in FIGS. 12A to 12C. The diagnosis discrimination routine is performed, only when the tentative discrimination routine has determined that there is a malfunction, and the diagnosis discrimination is not performed. The purge cutting mode, in which the fuel vapor amount is adsorbed in the adsorbent in the canister, is performed for the purge cut time period T in such a manner that the amount of the adsorbed fuel vapor in the canister does not become excessive, and after the purge cutting mode is performed the above described diagnosis discrimination is performed, thus preventing the malfunction detection from being erroneously made as in the conventional apparatus. Also, it is possible to suitably adjust the purge cut time period T, during which the fuel vapor in the fuel tank is adsorbed in the adsorbent in the canister, to the least possible level, and therefore the lowering of the adsorbing capacity of the canister, due to too much fuel vapor adsorbed in the canister, can be eliminated.

VSV Control Routine

Figure 13:
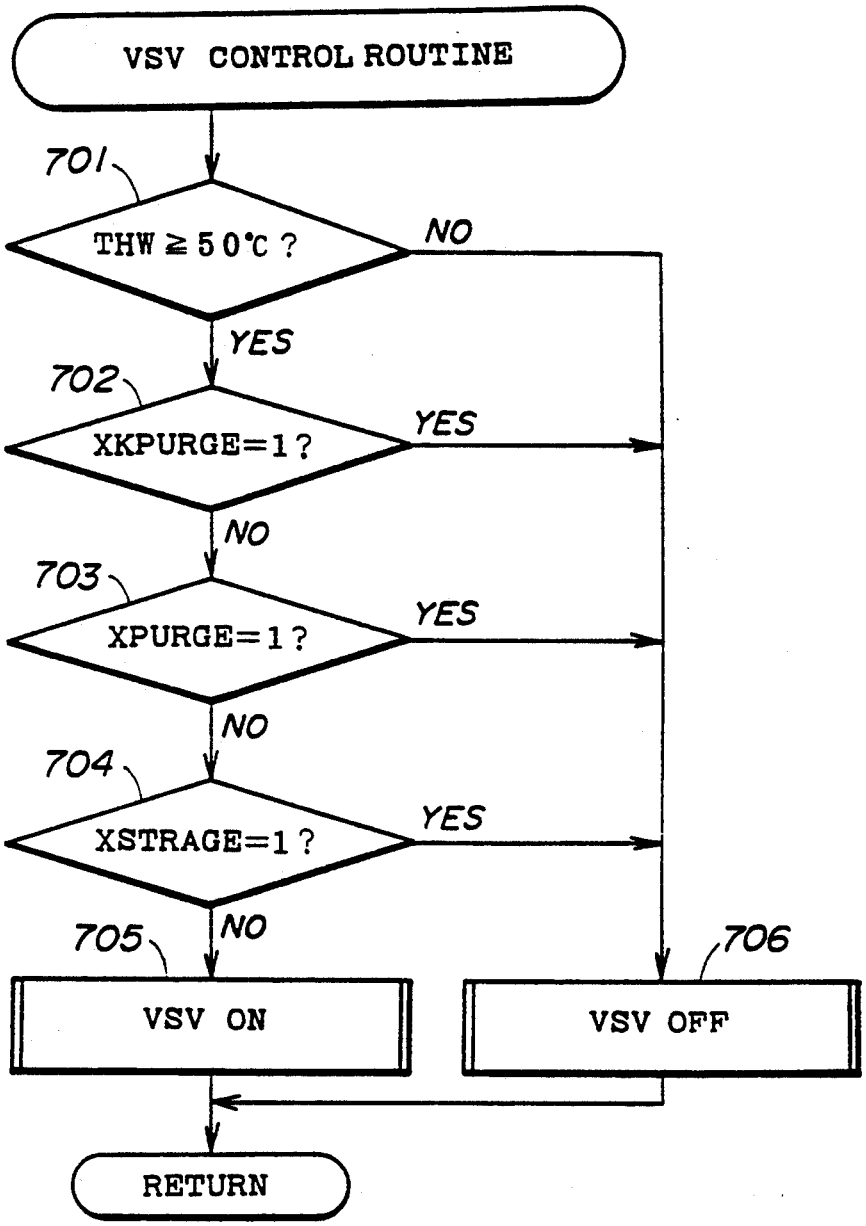
FIG. 13 is a flow chart for explaining a VSV control routine which is performed in the first embodiment of the present invention.

FIG. 13 shows the VSV control routine which is performed for controlling the flow of fuel vapor adsorbed in the adsorbent in the canister 44 into the intake passage of the engine by switching ON and OFF the VSV 46. The purge part 14 shown in FIG. 1 according to the present invention can be achieved by performing this VSV control routine. In the flow chart shown in FIG. 13, a step 701 determines whether the engine cooling water temperature THW indicated by an output signal of the water temperature sensor 39 is higher than 50 deg C. or not. If the step 701 determines that the engine cooling water temperature THW is higher than 50 deg C. (which indicates that the engine is in the warm-up condition), then a step 702 determines whether the purge cutting mode flag XKPURGE in the tentative discrimination routine is equal to "1". This flag XKPURGE is, in some cases, set to "1" in the step 108 in FIG. 4A, and in other cases the flag XKPURGE is set to "0" either in the step 109 in FIG. 4A or in the step 131 in FIG. 4C. If the step 702 determines that the flag XKPURGE is equal to "0", then a step 703 determines whether the purge cutting mode flag XPURGE in the diagnosis discrimination routine is equal to "1". This flag XPURGE is, in some cases, set to "1" in the step 609 in FIG. 12A, and in other cases the flag XPURGE is set to "0" either in the step 610 in FIG. 12A or in the step 632 in FIG. 12C.

If the step 703 determines that the flag XPURGE is equal to "0", then a step 704 determines whether the flag XSTRAGE is equal to "1". This flag XSTRAGE is, in some cases, set to "1" in the step 504 in FIG. 10, and in other cases the flag XSTRAGE is set to zero "0" in the step 508 in FIG. 10. If the step 704 determines that the flag is equal to "0", then a step 705 allows the microcomputer 21 to supply a control signal to the VSV 46, this control signal enabling the VSV 46 to be switched ON so that the purging mode is performed. On the other hand, if the step 701 determines that the engine cooling water temperature THW is not higher than 50 deg C, or if the step 702 determines that the flag XKPURGE is equal to "1", or if the step 703 determines that the flag XPURGE is equal to "1", or the step 704 determines that the flag XSTRAGE is equal to "1", then a step 706 allows the microcomputer 21 to supply a control signal to the VSV 46, this control signal enabling the VSV 46 to be switched OFF so that the purge cutting is performed. After either the step 705 or the step 706 is performed, the VSV control routine is ended.

Figure 14:
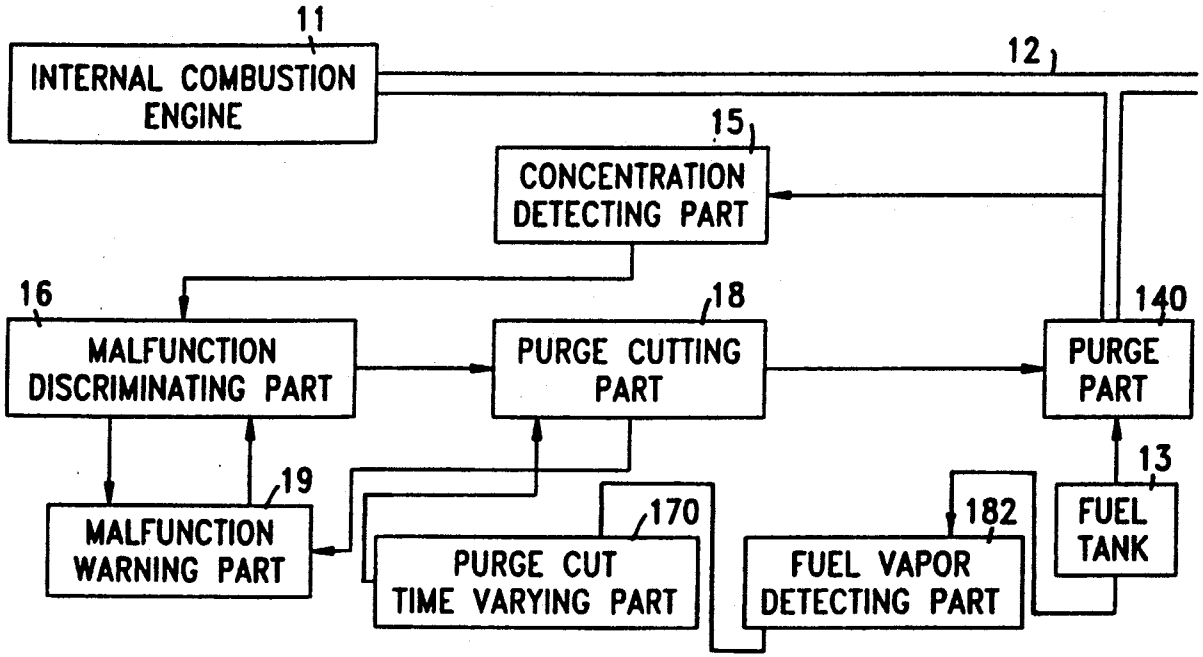
FIG. 14 is a block diagram showing a construction of another embodiment of the malfunction detection apparatus according to the present invention.

Next, a description will be given of another embodiment of a malfunction detection apparatus according to the present invention, with reference to FIGS. 14 to 17. FIG. 14 shows another embodiment of the malfunction detection apparatus. In FIG. 14, those parts which are essentially the same as those corresponding parts of the first embodiment shown in FIG. 1 are designated by the same reference numerals, and a description thereof will be omitted. This malfunction detection apparatus includes a purge part 140 for allowing fuel vapor evaporated in the fuel tank 13 to be adsorbed in an adsorbent in a canister and for purging the adsorbed fuel vapor in the adsorbent in the canister into the intake passage 12 of the internal combustion engine 11, a concentration detecting part 15 for detecting a concentration of fuel in the purged fuel vapor by the purge part 140, a malfunction discriminating part 16 for performing a malfunction discrimination by determining that there is a malfunction in the evaporated fuel purge system, only when a change in the detected fuel concentration by the concentration detecting part 15 from a time when a purge cutting is performed to a time when a purging is performed by the purge part 140 is not greater than a predetermined value, a purge cutting part 18 for performing the purge cutting continuously for a predetermined time period, a fuel vapor detecting part for detecting a condition of fuel vapor in the fuel tank 13, a purge cut time varying part 170 for determining the time period for which the purging of the fuel vapor into the intake passage is stopped continuously by the purge cutting part 18, and a malfunction process part 19 for allowing the malfunction discrimination part 16 to perform a second malfunction discrimination after the purge cutting has been performed and for performing a malfunction process when the malfunction discrimination part 16 has determined in the second malfunction discrimination that there is the malfunction. The malfunction process part 19 includes a malfunction warning lamp for giving a warning of the located malfunction to a driver. The purge cutting part 18 performs the purge cutting by temporarily stopping the purging of the fuel vapor into the intake passage by the purge part 140 when the malfunction discriminating part 16 has determined that there is a malfunction in the evaporated fuel purge system. The malfunction process part 19 allows the malfunction discriminating part 16 to perform a second malfunction discrimination after the purging of the fuel vapor into the intake passage is temporarily stopped by the purge cutting part 18. The malfunction process part 19 also performs a malfunction process including giving a warning of the malfunction to a driver when the malfunction discriminating part 16 has determined in the second malfunction discrimination that there is the malfunction.

According to the present invention, when it is determined in a first malfunction discrimination that a change in the detected fuel concentration from a time before the purging is performed to a time after the purging is performed by the purge part 140 is not greater than a predetermined value, the purging of the fuel vapor is temporarily stopped by the purge cutting part 18 so that fuel vapor evaporated in the fuel tank 42 is adsorbed in the adsorbent in the canister for a prescribed time period or until an integrated value of an output signal of the pressure sensor **49*a* reaches a predetermined value. After the purge cutting is performed, the malfunction discriminating part 10** performs again a malfunction discrimination with a sufficient fuel vapor being adsorbed in the canister so that a malfunction discrimination is performed accurately and an erroneous malfunction detection is eliminated.

Figure 15:
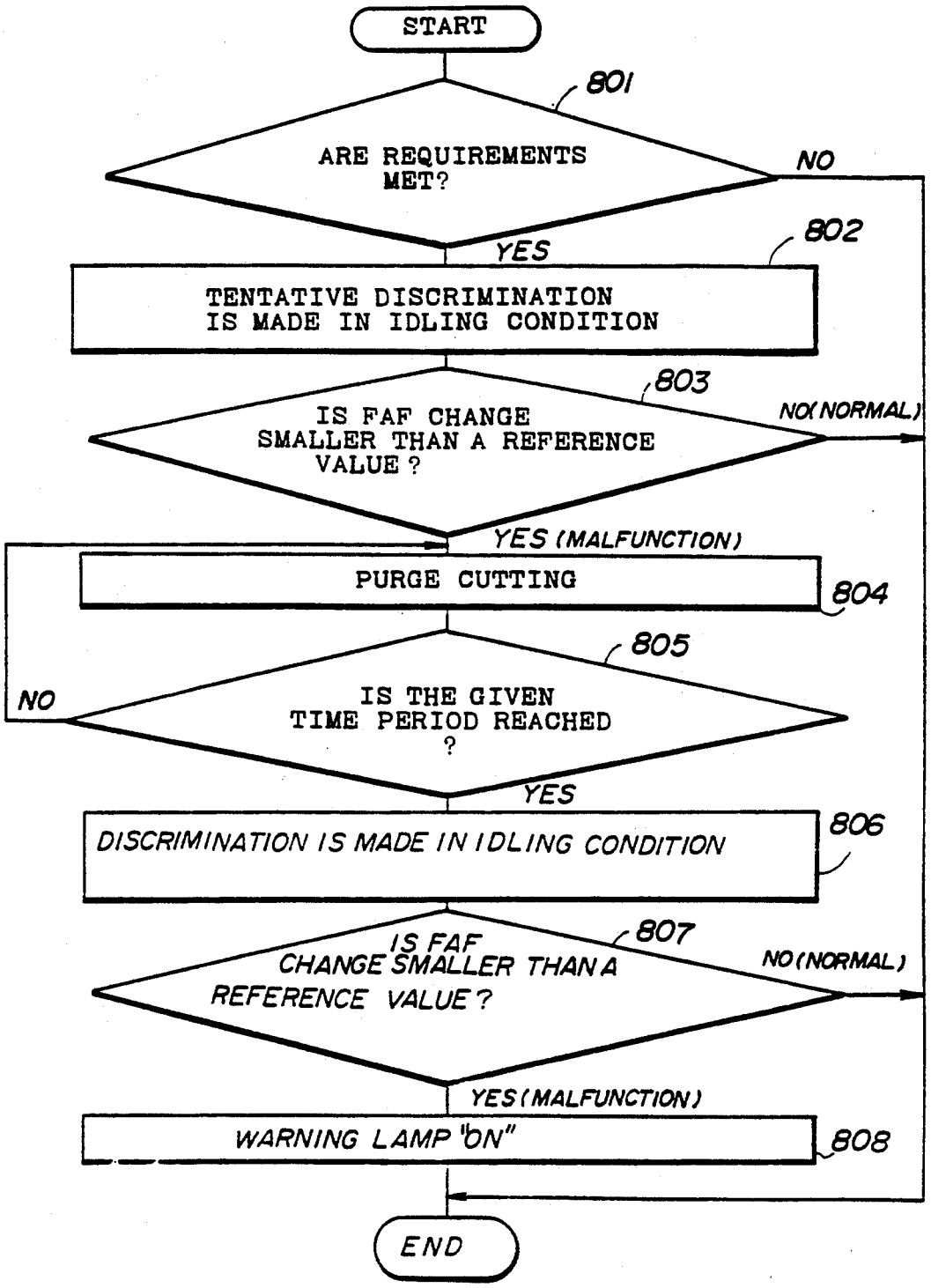
FIG. 15 is a flow chart for explaining a second embodiment of the malfunction detection apparatus of the present invention.

FIG. 15 shows a malfunction detection procedure which is performed in a second embodiment of the present invention. This malfunction detection procedure is carried out by the CPU 50 of the microcomputer 21 in accordance with a control program stored in the ROM 51, and the above mentioned concentration detecting part 15, the malfunction discriminating part 16, the purge cutting part 18, the fuel vapor detecting part 182 and the purge cut time varying part 170 are achieved by performing the malfunction detection procedure shown in FIG. 15, by means of the CPU 50 in accordance with the control program stored in the ROM 51. The malfunction process part 19 is also achieved by performing the malfunction detection procedure by means of the microcomputer 21 and the warning lamp 47.

In the flow chart shown in FIG. 15, a step 801 determines whether the requirements for starting the malfunction detection procedure to detect a malfunction in the evaporated fuel purge system are met or not. If the step 801 determines that any of the requirements is not met, then the procedure is ended. If the step 801 determines that the requirements are met, then a step 802 performs a tentative malfunction discrimination by setting the evaporated fuel purge system in the idling condition (the throttle position sensor 26 in FIG. 2 is switched ON) and performs a purging of fuel vapor into the intake passage (the vacuum switching valve 46 is switched ON). The reasons why the tentative discrimination is performed with the system set in the idling condition are that the amount of intake air in the idling condition can be smaller than the amount of intake air in normal operating condition so the A/F feedback correction factor FAF, used for making a malfunction discrimination, is changed appreciably great when the system is set in the idling condition. In a case in which a malfunction discrimination is performed during the normal operating condition (or, the system is set in a certain loading condition), it is difficult to detect changes in the A/F feedback correction factor FAF which are smaller than otherwise, and there is a possibility that a malfunction discrimination may be made erroneously because of such small changes in the FAF which are detected in the normal operating condition.

A step 803 shown in FIG. 15 tentatively determines whether there is a malfunction in the evaporated fuel purge system by checking if a change in the A/F feedback correction factor FAF is not greater than a predetermined value. When the FAF is changed to a "lean" value, the step 803 determines that there is no malfunction, and then the malfunction detection procedure is ended. When the FAF is changed to a "rich" value or remains unchanged, the step 803 determines that there is a malfunction in the evaporated fuel purge system.

If it is determined that there is a malfunction, then a step 804 performs a purge cutting by switching the VSV 46 OFF in order to temporarily stop the purging of fuel vapor into the intake passage so that sufficient fuel vapor is adsorbed in the adsorbent in the canister 44 for making an accurate malfunction discrimination.

And, a step 805 makes a determination whether the purge cutting is performed continuously for a predetermined time period. The reasons why the purge cutting is performed continuously for more than a predetermined time period is to eliminate a case in which the adsorbed fuel vapor in the adsorbent in the canister 44 is fed into the intake passage during the normal operating condition and sufficient fuel vapor does not remain within the canister 44 even when the step 803 determines that there is a malfunction.

After the purge cutting is performed continuously and sufficient fuel vapor is adsorbed in the adsorbent in the canister 44, a step 806 performs a malfunction discrimination with the system set in the idling condition so that a change in the FAF from a time before the purging is performed to a time after the purging is performed is calculated, and a step 807 determines whether there is a malfunction in the evaporated fuel purge system by checking if the calculated change in the FAF is smaller than the predetermined value. If the step 807 determines that the change in the FAF is not smaller than the predetermined value, then the procedure is ended. If the step 807 determines that the change in the FAF is smaller than the predetermined reference value, then a step 808 switches the warning lamp 47 ON in order to give to a driver a warning of the malfunction in the evaporated fuel purge system.

According to the present invention, a first malfunction discrimination is performed in response to a change in the A/F feedback correction factor FAF from a time when the purge cutting is performed to a time when the purging is performed. When it is temporarily determined that there is a malfunction in the system in response to the change in the FAF, the purge cutting is performed continuously for more than a predetermined time period and then a second malfunction discrimination is performed so that a malfunction in the system can be accurately detected. Thus, it is possible to remarkably reduce the number of erroneously detected malfunctions due to no sufficient fuel vapor in the adsorbent in the canister 44. Also, a malfunction discrimination is performed when the system is set in the idling condition, and it is possible to detect more accurately and safely a malfunction in the system, than in the case in which a malfunction discrimination is performed when the system is set in the normal operating condition.

Figure 16:
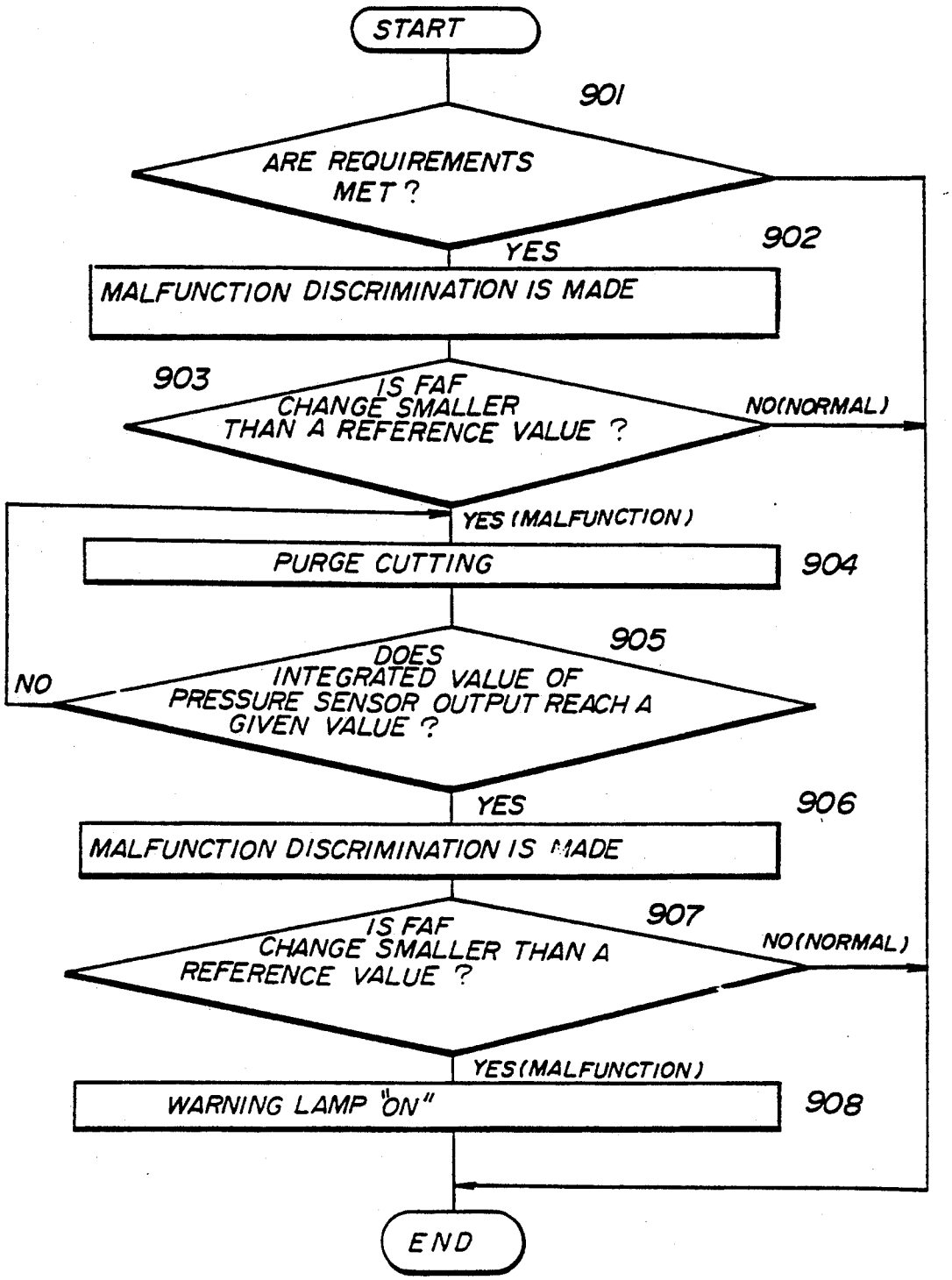
FIG. 16 is a flow chart for explaining a third embodiment of the malfunction detection apparatus of the present invention.
Figure 17:
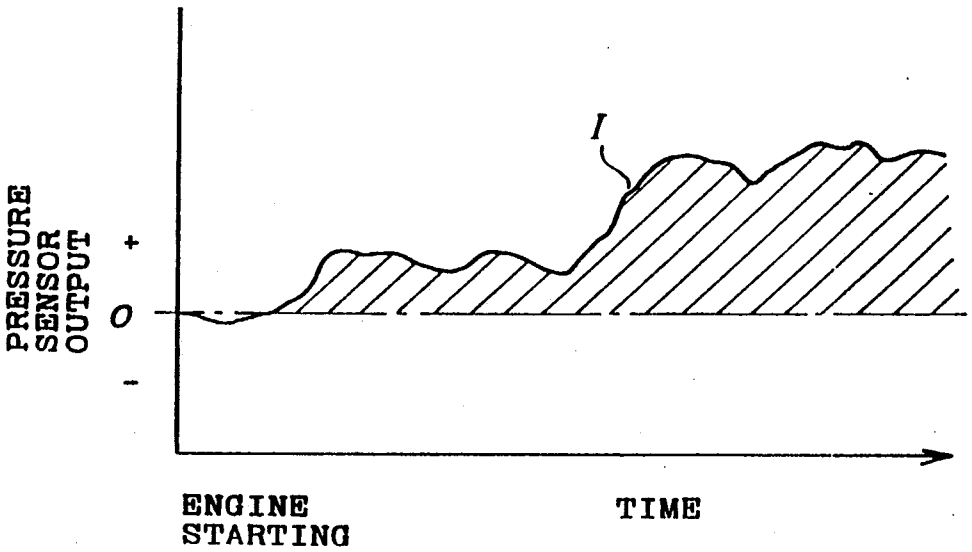
FIG. 17 is a diagram for explaining an essential part of the flow chart shown in FIG.16.

FIG. 16 shows a malfunction detection procedure which is performed in a third embodiment of the present invention. In the flow chart shown in FIG. 16, a step 901 makes a determination whether the requirements for starting the malfunction detection procedure are met or not. This determination is made by the microcomputer 21. If all the requirements for performing a malfunction discrimination are met, then a step 902 performs a malfunction discrimination by calculating a difference between the FAF average value FAFOFF when a purge cutting is performed and the FAF average value FAFON when a purging is performed (the difference=FAFOFF−FAFON). In the present embodiment, the malfunction discrimination may be performed with the system being placed in either the idling condition or the driving condition. A step 903 determines whether the calculated difference between FAFOFF and FAFON is smaller than a predetermined reference value. When the difference (=FAFOFF−FAFON) is greater than the predetermined reference value, it is discriminated that the evaporated fuel purge system operates normally and there is no malfunction, and the malfunction detection procedure is ended. When the difference is smaller than the predetermined reference value, it is discriminated that there is a malfunction in the evaporated fuel purge system, and a step 904 performs a purge cutting by switching OFF the VSV 46 so that the purging of fuel vapor is stopped. While the purge cutting is performed, a step 905 determines whether an integrated value of an output signal of the pressure sensor **49*a* mounted on the fuel tank 42 at a prescribed position thereof, shown in FIG. 2**, reaches a predetermined value. The integrating of the output signal is started from the time when the purge cutting is started.

The output signal of the pressure sensor **49*a* indicates an evaporated fuel gas pressure in the fuel tank 42. As being indicated by a solid line I in FIG. 17, the output signal of the pressure sensor 49*a* is increased as the fuel temperature in the fuel tank 42 is increased after the engine starts operation. The evaporated fuel gas pressure becomes a positive pressure when fuel vapor evaporated in the fuel tank 42 is fed into the canister 44. The step 905 shown in FIG. 16 calculates the integrated value of the pressure sensor output including a positive pressure part only, which represents the area of a shaded portion of FIG. 17. When the integrated value of the pressure sensor output calculated in the step 905 reaches a predetermined value, it is determined that the necessary amount of fuel vapor is adsorbed in the adsorbent in the canister 44**.

If the step 905 determines that the integrated pressure sensor output exceeds a predetermined value, then a step 906 performs a malfunction discrimination, in the same manner as the step 902, by calculating a difference between the FAFOFF when a purge cutting is performed and the FAFON when a purging is performed (the difference=FADOFF−FAFON). And, similarly to the step 903, a step 907 performs a malfunction discrimination by determining whether the calculated difference (=FAFOFF−FAFON) is smaller than the predetermined reference value. If the step 907 determines that the calculated difference is smaller than the reference value and there is a malfunction, then a step 908 switches ON the warning lamp 47 in order to give to a driver a warning of the malfunction located in the evaporated fuel purge system. If the step 907 determines that the calculated difference is not smaller than the reference value and the system operates normally with no malfunction, then the malfunction detection procedure is completed.

It is not certain whether the necessary amount of fuel vapor is adsorbed in the adsorbent in the canister by checking the elapse of the predetermined time period only, as in the second embodiment. The amount of fuel vapor evaporated in the fuel tank 42 during the purge cutting mode is varied depending on the operating conditions, temperature conditions and weather conditions. However, according to the third embodiment, it is possible to control more accurately the amount of fuel vapor being adsorbed in the adsorbent in the canister when compared with the case of the second embodiment, because the purge cutting is performed continuously until an integrated value of an output signal of the pressure sensor reaches a predetermined value.

Further, the present invention is not limited to the above described embodiments, and variations and modifications may be made without departing from the scope of the present invention.

What is claimed is:

1. An apparatus for detecting a malfunction in an evaporated fuel purge system provided in an internal combustion engine, comprising:

purge means for performing alternately a purging mode and a purge cutting mode, fuel vapor from a fuel tank being adsorbed in an adsorbent in a canister when said purge cutting mode is performed by said purge means, and when said purging mode is performed by said purge means the adsorbed fuel vapor in the adsorbent being purged into an intake passage of the internal combustion engine;

detection means for detecting an air-fuel ratio of the fuel vapor being purged into the intake passage so that a change in the air-fuel ratio of the fuel vapor, from a time when the purge cutting mode is performed to a time when the purging mode is performed by said purge means immediately after said purge cutting mode has been performed, is detected;

malfunction discrimination means for determining whether there is a malfunction in the evaporated fuel purge system, by comparing said change in said detected air fuel ratio of the fuel vapor detected by said detection means with a predetermined value;

fuel vapor detection means for detecting a fuel vapor pressure in the fuel tank; and purge cut time varying means, coupled to said purge means, said purge cut time varying means determining a purge cut time, during which said purge cutting mode is continuously performed by said purging means, said purge cut time being varied by said purge cut time varying means in response to said fuel vapor pressure in the fuel tank detected by said fuel vapor detection means, wherein the purge cut time is determined based on the fuel vapor pressure of the fuel tank detected by said fuel vapor detection means.

2. The apparatus as claimed in claim 1, wherein said purge means includes said canister, a vacuum switching valve, a vapor passage connecting said fuel tank to said canister, a purge passage connecting said canister to said intake passage of the internal combustion engine through said vacuum switching valve, and a microcomputer having a memory part.

3. The apparatus as claimed in claim 2, wherein said purge cut time varying means calculates said purge cut time on the basis of a set of two-dimensional maps stored in said memory part of said microcomputer, in response to the conditions of the fuel vapor evaporated in the fuel tank, said conditions of said fuel vapor including a fuel amount correction factor, a fuel supply correction factor, an intake air temperature correction factor and an engine cooling water temperature correction factor which are defined in said set of two-dimensional maps stored in said memory part.

4. An apparatus according to claim 1, wherein said purge cut time varying means changes a previous purge cut time to a first time when said fuel vapor pressure is higher than a predetermined pressure, said first time being smaller than said previous purge cut time, whereby a current purge cut time during which the purge cutting mode is performed b said purge means is reduced.

5. An apparatus according to claim 1, wherein said purge cut time varying means changes a previous purge cut time to a second time when said fuel vapor pressure is at least as high as a predetermined pressure, said second time being greater than said previous purge cut time, whereby a current purge cut time during which the purge cutting mode is performed by said purge means is increased.

* * * * *

UNITED STATES PATENT AND TRADEMARK OFFICE

CERTIFICATE OF CORRECTION

PATENT NO. : 5,313,925

DATED : May 24, 1994

INVENTOR(S) : Takayuki OTSUKA, et al.

It is certified that error appears in the above-indentified patent and that said Letters Patent is hereby corrected as shown below:

On title page item [54], change "PRURGE" to --PURGE--.

Column 1, line 3, change "PRURGE" to --PURGE--.

Column 2, line 44, change "problem" to --problems--.

Column 3, line 39, between "used" and "the" insert --in--.

Column 5, line 39, change "An spark plug" to --A spark plug--.

Column 9, line 17, change "includes" to --include--.

Column 11, lines 25 and 26, delete "Purge Cut Time Calculation." and move to next line by itself as follows: --[Purge Cut Time Calculation.]--.

Column 11, line 51, change "a" to --an--.

Column 13, line 26, delete "fuel" (second occurrence).

UNITED STATES PATENT AND TRADEMARK OFFICE

CERTIFICATE OF CORRECTION

PATENT NO. : 5,313,925

DATED : May 24, 1994

INVENTOR(S) : Takayuki OTSUKA, et al.

It is certified that error appears in the above-indentified patent and that said Letters Patent is hereby corrected as shown below:

Column 18, line 43, delete "great".

Column 19, line 40, change "no sufficient" to --insufficient--.

Column 20, line 17, delete "being".

Column 20, line 37, change "FADOFF" to --FAFOFF--.

Signed and Sealed this

Nineteenth Day of September, 1995

*Attest:*

Bruce Lehman

BRUCE LEHMAN

*Attesting Officer*

*Commissioner of Patents and Trademarks*